US010907384B2

(12) United States Patent
Damboiu et al.

(10) Patent No.: US 10,907,384 B2
(45) Date of Patent: Feb. 2, 2021

(54) MOTOR VEHICLE DOOR LATCH DEVICE

(71) Applicant: GECOM CORPORATION, Greensburg, IN (US)

(72) Inventors: Cristian Damboiu, Novi, MI (US); Bryan Farris, Novi, MI (US)

(73) Assignee: GECOM CORPORATION, Greensburg, IN (US)

( * ) Notice: Subject to any disclaimer, the term of this patent is extended or adjusted under 35 U.S.C. 154(b) by 665 days.

(21) Appl. No.: 15/551,439

(22) PCT Filed: Feb. 17, 2015

(86) PCT No.: PCT/JP2015/054349

§ 371 (c)(1),
(2) Date: Aug. 16, 2017

(87) PCT Pub. No.: WO2016/132464

PCT Pub. Date: Aug. 25, 2016

(65) Prior Publication Data

US 2018/0038137 A1 Feb. 8, 2018

(51) Int. Cl.
*E05B 81/06* (2014.01)
*E05B 77/26* (2014.01)
(Continued)

(52) U.S. Cl.
CPC ..... *E05B 77/30* (2013.01); *E05B 77/26* (2013.01); *E05B 79/08* (2013.01); *E05B 81/06* (2013.01);
(Continued)

(58) Field of Classification Search
CPC ..... Y10T 292/1082
See application file for complete search history.

(56) References Cited

U.S. PATENT DOCUMENTS 6,733,052 B2 * 5/2004 Perkins ..... E05B 81/06 267/153
7,926,857 B2 * 4/2011 Akizuki ..... E05B 77/26 292/201
(Continued)

FOREIGN PATENT DOCUMENTS

JP 3758929 B2 9/2001
JP 4617588 B2 10/2002
(Continued)

OTHER PUBLICATIONS

International Search Report Corresponding to PCT/JP2015/054349 dated May 19, 2015.
Written Opinion Corresponding to PCT/JP2015/054349 dated May 19, 2015.

*Primary Examiner* — Carlos Lugo
(74) *Attorney, Agent, or Firm* — Davis & Bujold PLLC; Michael J. Bujold

(57) ABSTRACT

A motor vehicle door latch device comprises an engagement unit that can engage with a striker and an operating unit attached to the engagement unit. The operating unit comprises an operating mechanism. The operating mechanism comprises a locking motor; a locking mechanism comprising mechanical elements that can be shifted to an unlock state and a lock state based on drive of the locking motor; an electric release motor for releasing the opening lever regardless of a state of the locking mechanism based on drive of the releasing motor; and an inside lever that is pivotally mounted, via a first shaft, for pivotally mounting the electric release lever to a housing and is rotated based on a door opening action of the internal mechanical elements thereby releasing the opening lever, when the locking mechanism is in an unlock state.

10 Claims, 23 Drawing Sheets

(51) Int. Cl.

| | |
|---|---|
| ***E05B 77/30*** | (2014.01) |
| ***E05B 81/16*** | (2014.01) |
| ***E05B 81/14*** | (2014.01) |
| ***E05B 79/08*** | (2014.01) |
| ***E05B 81/42*** | (2014.01) |
| ***E05B 81/50*** | (2014.01) |
| ***E05B 81/34*** | (2014.01) |
| ***E05B 81/90*** | (2014.01) |
| *E05B 81/76* | (2014.01) |
| *E05B 83/36* | (2014.01) |
| *E05B 77/06* | (2014.01) |

(52) U.S. Cl.

CPC ..... *E05B 81/14* (2013.01); *E05B 81/16* (2013.01); *E05B 81/34* (2013.01); *E05B 81/42* (2013.01); *E05B 81/50* (2013.01); *E05B 81/90* (2013.01); *E05B 77/06* (2013.01); *E05B 77/265* (2013.01); *E05B 81/77* (2013.01); *E05B 83/36* (2013.01); *Y10T 292/1082* (2015.04)

(56) References Cited

U.S. PATENT DOCUMENTS

| | | | | |
|---|---|---|---|---|
| 8,146,965 | B2 * | 4/2012 | Akizuki | E05B 81/06 292/201 |
| 8,151,610 | B2 * | 4/2012 | Fujihara | E05B 77/283 292/201 |
| 8,256,805 | B2 * | 9/2012 | Ishiguro | E05B 77/26 292/201 |
| 8,267,444 | B2 * | 9/2012 | Akizuki | E05B 77/26 292/201 |
| 8,474,888 | B2 * | 7/2013 | Tomaszewski | E05B 77/26 292/201 |
| 8,870,247 | B2 * | 10/2014 | Yamagata | E05B 77/34 292/201 |
| 2016/0076277 | A1 * | 3/2016 | Kouzuma | E05B 81/68 292/201 |

FOREIGN PATENT DOCUMENTS

| | | | |
|---|---|---|---|
| JP | 4145774 | B2 | 6/2005 |
| JP | 2013-002247 | A | 1/2013 |

* cited by examiner (DESIGN 1)

(LOCK STATE)

(DESIGN 1)

(DESIGN 1)

(DESIGN 1)

(DESIGN 2)

(DESIGN 2)

(DESIGN 2)

(DESIGN 3)

(DESIGN 3)

(DESIGN 3)

(DESIGN 4)

(DESIGN 4)

(DESIGN 5)

(DESIGN 5)

(DESIGN 5)

MOTOR VEHICLE DOOR LATCH DEVICE

BACKGROUND OF THE INVENTION

The present invention relates to a motor vehicle door latch device.

A motor vehicle door latch device comprises an engagement mechanism engaging with a striker of a vehicle body to hold a door closed, and an operating mechanism for operating the engagement mechanism, and is classified to a manually releasing type for enabling the engagement mechanism to be released by mechanical elements such as a lever and a link based on operation of mechanical elements such as an outside handle or an inside handle on the door and an electrical release type for enabling the engagement mechanism to be released by electric elements such as a motor for driving on the basis of electric operating elements such as a switch on the door.

As described in JP3758929B2, the manually releasing type door latch device comprises a locking motor, and a locking mechanism (operating mechanism in JP3758929B2) that comprises a lever and a link for selectively shifting an unlocking state that validates a door-opening action of the mechanical operating elements to enable the engagement mechanism to be released based on the locking motor and a lock state that invalidates the opening action enabling the engagement mechanism not to be released.

The electrically releasing type of door latch device is described in JP4145774B2 and JP4617588B2.

The door latch device in JP4145774B2 comprises an electric release mechanism comprising a releasing motor that can be driven with a door-opening switch on the door and an output lever that is rotated by the motor to release the engagement mechanism; and an opening lever pivotally mounted via the same axis for the output lever. A ratchet lever for releasing the engagement mechanism is connected to an outside operating lever positioned outside the vehicle and is not used during usual operation. The opening lever is connected to an inside lever inside the vehicle via a second wire. A control device in the vehicle electrically shifts an unlock state for validating a door-opening switch and a lock state for invalidating it.

In the door latch device in JP414577482, ID signals are identified through a wireless communication between an electronic key (portable device in JP4145774B2) carried by a regular user for the car and an authenticating portion in the car, and it is authenticated that the regular user approaches the car. The door-opening switch is operated by the regular user and a release motor is driven. The engagement mechanism is released by a ratchet lever to enable the door to open. If an electric system including a linear motor is broken, an external mechanical operating element or an internal mechanical operating element is operated whether the control device control the unlock state or the lock state, to actuate the ratchet lever to release the engagement mechanism to enable the door to open. In this structure, if the regular user who approaches the car is not authenticated by the authenticating portion through the ID signal, a passenger without the electronic key cannot open the door.

The motor vehicle door latch device in JP4145774B2 mainly comprises a releasing motor, an opening lever that can be rotated by the motor; an inside lever connected to an internal mechanical operating element ("inside handle" in JP4145774B2) on the door inside the vehicle; an opening link for enabling the engagement mechanism to be released by the inside lever and the opening lever; and a key lever connected to a key cylinder on the door outside the vehicle:

Besides electric control of a control device, the door is shifted to an unlock state and a lock state by actuating the opening link for locking, thereby invalidating an opening action of the internal mechanical operating elements.

In the door latch device in JP4145774B2, when the control device controls the unlock state, an opening switch on the door is operated and a releasing motor is controlled to release the engagement mechanism to enable the door to open. If trouble occurs in electric systems, regardless of the unlock state or lock state, the key cylinder releases the engagement mechanism to enable the door to open.

In the manually releasing motor vehicle door latch device, the engagement mechanism and basic structure for the operating mechanism (structure except an internal operating system connected to an internal mechanical operating element or an inside handle) are used in common, and various designs are determined to differ internal operating systems for the internal mechanical operating element.

For example, as the internal operating system, in a door opening action of the internal mechanical operating element when a locking mechanism that comprises mechanical element is in a lock state, the door cannot be opened even if the internal mechanical operating element is operated to open the door (Design 1 applied to the front door and the rear door); the locking mechanism is shifted to the unlock state by the first door-opening action of the internal mechanical operating element, and the door can be opened by the second door-opening action (Design 2 applied to the front door); the locking mechanism is shifted to the unlock state with releasing of the engagement mechanism by a one-time door-opening action of the internal mechanical operating element (Design 3 applied to the front door); the door cannot be opened based on a door-opening action of the internal mechanical operating element when the locking mechanism is in the unlock state and the childproof mechanism is in the childproof lock state (Design 4 applied to the rear door): and the locking mechanism is shifted from the lock state to the unlock state by a door-opening action of the internal mechanical operating element besides the Design 4 (Design 5 applied to the rear door)

However, in the motor vehicle door latch device, in order to improve a door-opening activity of a regular user with an electronic key, to improve dealing with trouble in the electric system, and to improve a door-opening activity of a passenger without the electronic key, it is preferable to comprise the releasing motor in JP4145774B2 or JP4617588B2 together with the locking mechanism and locking motor that comprises the mechanical elements in JP3758929B2. But in order to provide the releasing motor, the locking motor and the locking mechanism together and to set each of the designs for the internal operating system, the structure of each of the elements of the internal operating system is different in each of the Designs, and it becomes difficult to use the basic structure of the operating mechanism in each of the Designs.

SUMMARY OF THE INVENTION

In view of the disadvantages, it is an object of the invention to provide a motor vehicle door latch device that comprises a releasing motor, a locking motor and a locking mechanism and enables an operating mechanism to be used.

DETAILED DESCRIPTION OF PREFERRED EMBODIMENTS

One embodiment of the present invention will be described with respect to drawings.

Figure 1:
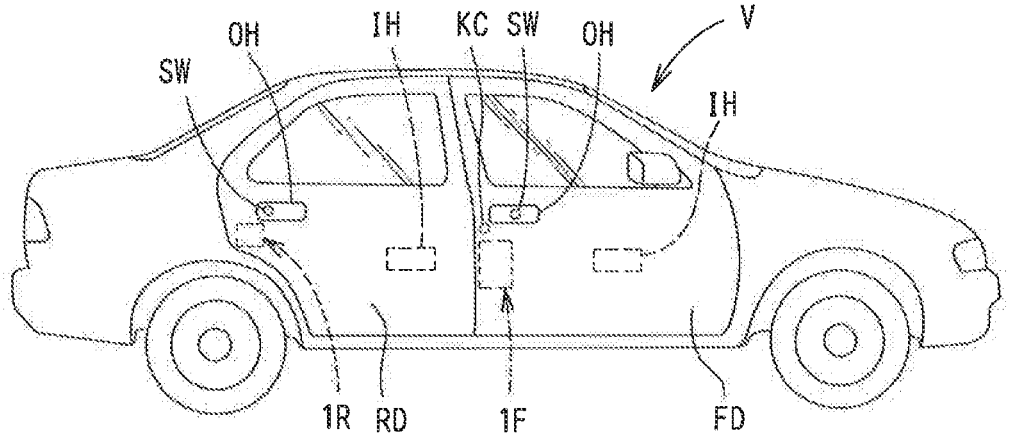
FIG. 1 is a side elevational view of a motor vehicle comprising a motor vehicle door latch device according to the present invention.

In FIG. 1, in a front door FD of a four-door-type motor vehicle V, there are provided a front-door door latch device 1F for holding a front door FD closed; an outside handle OH as external mechanical operating element on the door outside the vehicle; a detecting switch SW as electric detecting element on the door outside the vehicle; an inside handle IH as internal mechanical operating element on the door inside the vehicle; a key cylinder KC for selectively shifting a locking mechanism (later described) into a lock state and an unlock state from the outside of the vehicle; and a locking knob (not shown) for shifting the locking mechanism into the lock state and the unlock state from the inside of the vehicle. Any one of the following Designs 1 to 3 is set to the door latch device 1F.

A rear door RD comprises a door latch device 1R for a rear door for holding the rear door closed; an outside handle OH as an external mechanically operating element on the door outside the vehicle; a detecting switch SW as an electric detecting element on the door inside the vehicle; and a locking knob (not shown) for shifting the locking mechanism into the lock state and unlock state from the inside of the vehicle. The following Design 4 or 5 is set to the door latch device 1R.

The detecting switch SW as electric detecting element is disposed on a front surface, a back surface or close to the outside handle (OH), and comprises an electrostatic capacitance touch switch that detects that a finger of a user is touched. The regular user with an electronic key exclusively used for the car approaches within a predetermined area around the car, and an ID signal is identified though a wireless communication between the electronic key and a receiver of the car V. Thus, only when it is authenticated that the regular user comes to the car V, the detecting switch is electrically controlled by an ECU (electronic control unit) of the car V so that the user may be detected. The detecting switch is not limited to the touch switch, but may be a proximity switch detecting that part of a human body comes.

(Basic Structure of the Door Latch Device 1F, 1R)

Then, the basic structure of the door latch device 1F, 1R will be described.

The door latch devices 1F, 1R are the same to each other in the basic structure except part (including an internal operating element later described). Thus, the door latch device 1F in the Design 1 is described, and the door latch device 1R is interpreted without special description by replacing "door latch device 1F" with "door latch device 1R" and "front door FD" with "rear door RD". Each of the Designs will be described after the basic structure common with each of the Designs and actions therefor are described, The internal operating elements denote a lever and a link that connect a door-opening action of the inside handle IH, which will be described later.

Figure 2:
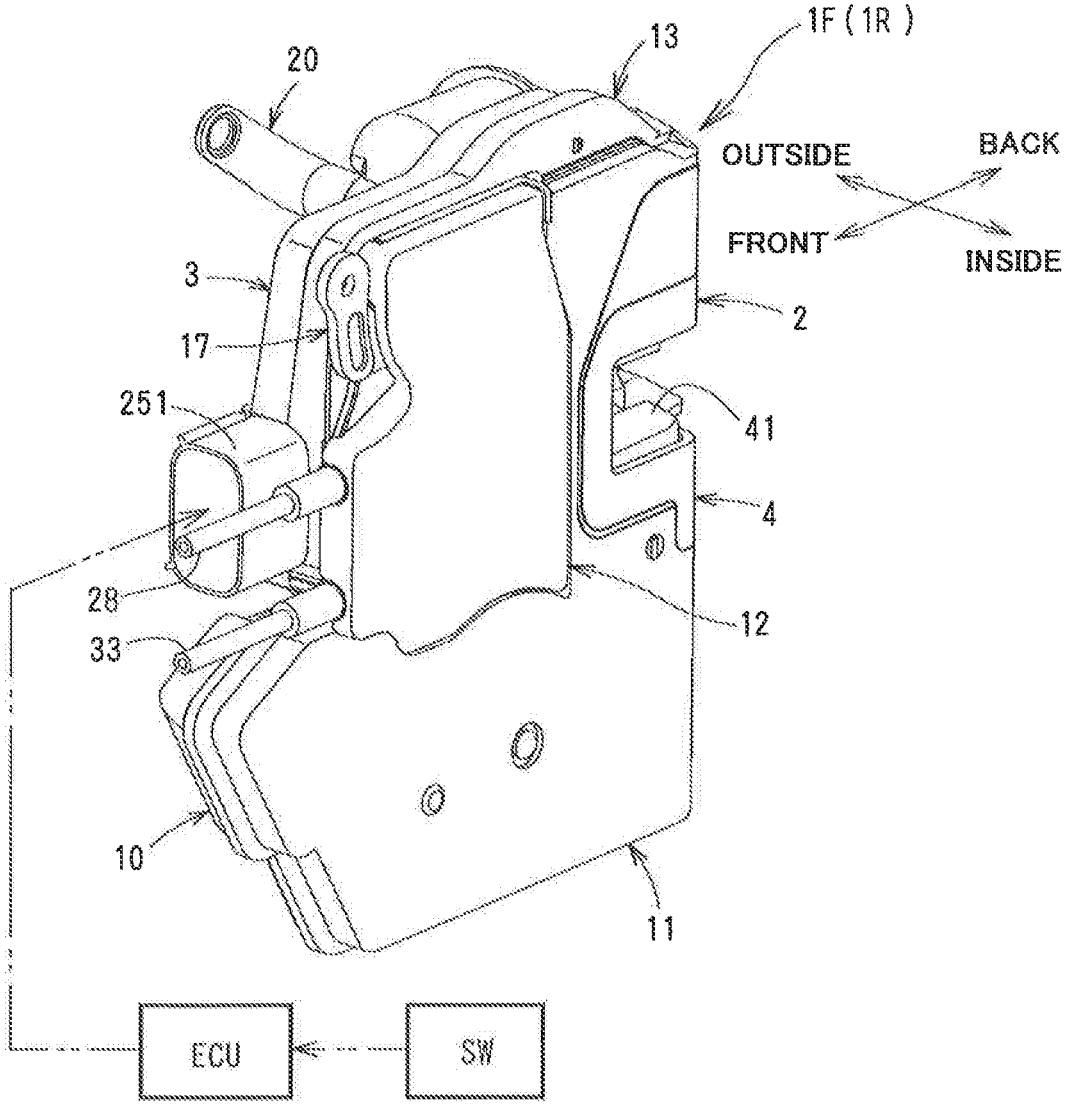
FIG. 2 is a perspective view of the door latch device that is the same among Designs.
Figure 3:
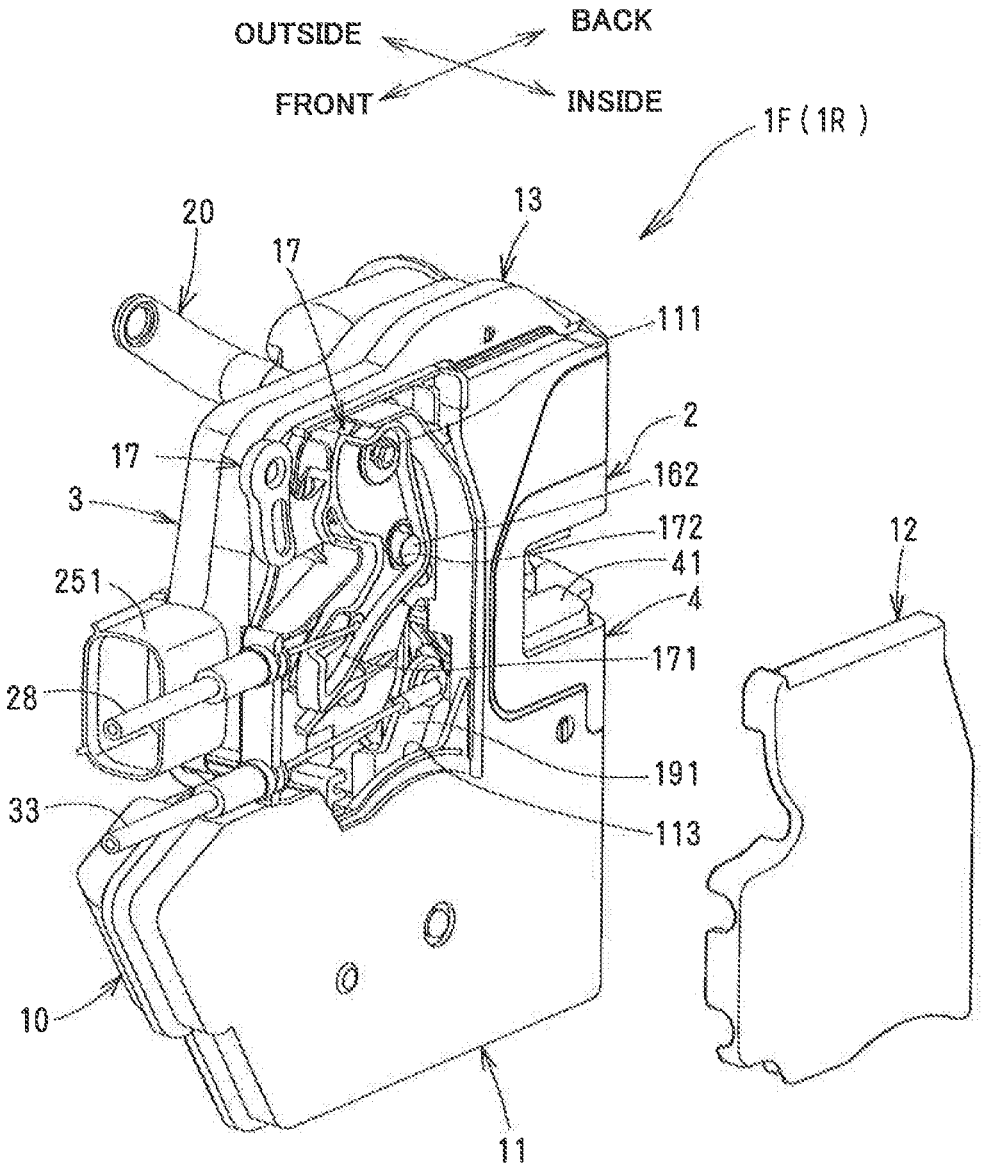
FIG. 3 is a partially exploded perspective view of the door latch device that is the same among the Designs.
Figure 4:
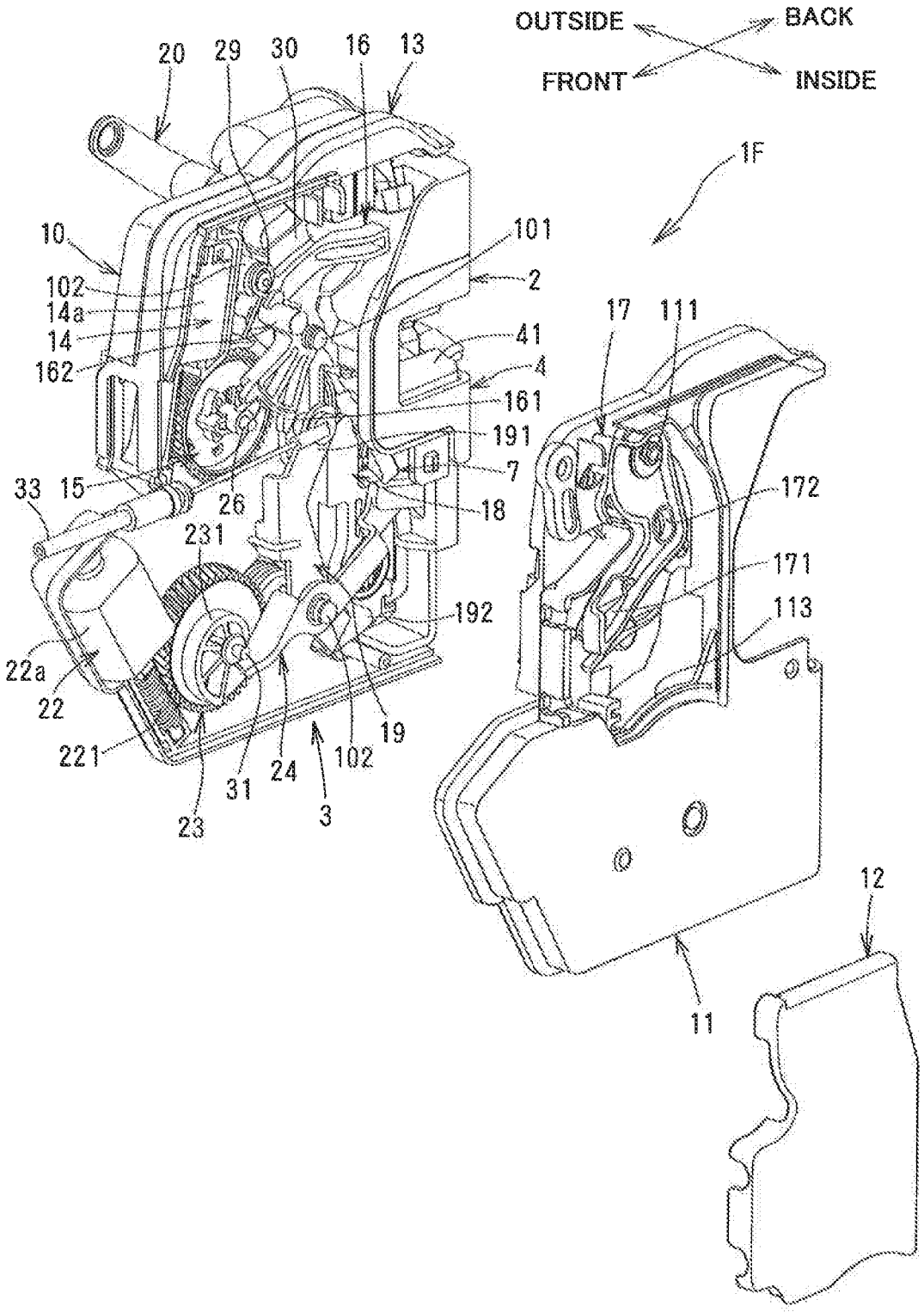
FIG. 4 is a partially exploded perspective view of the door latch device in the Design 1.
Figure 5:
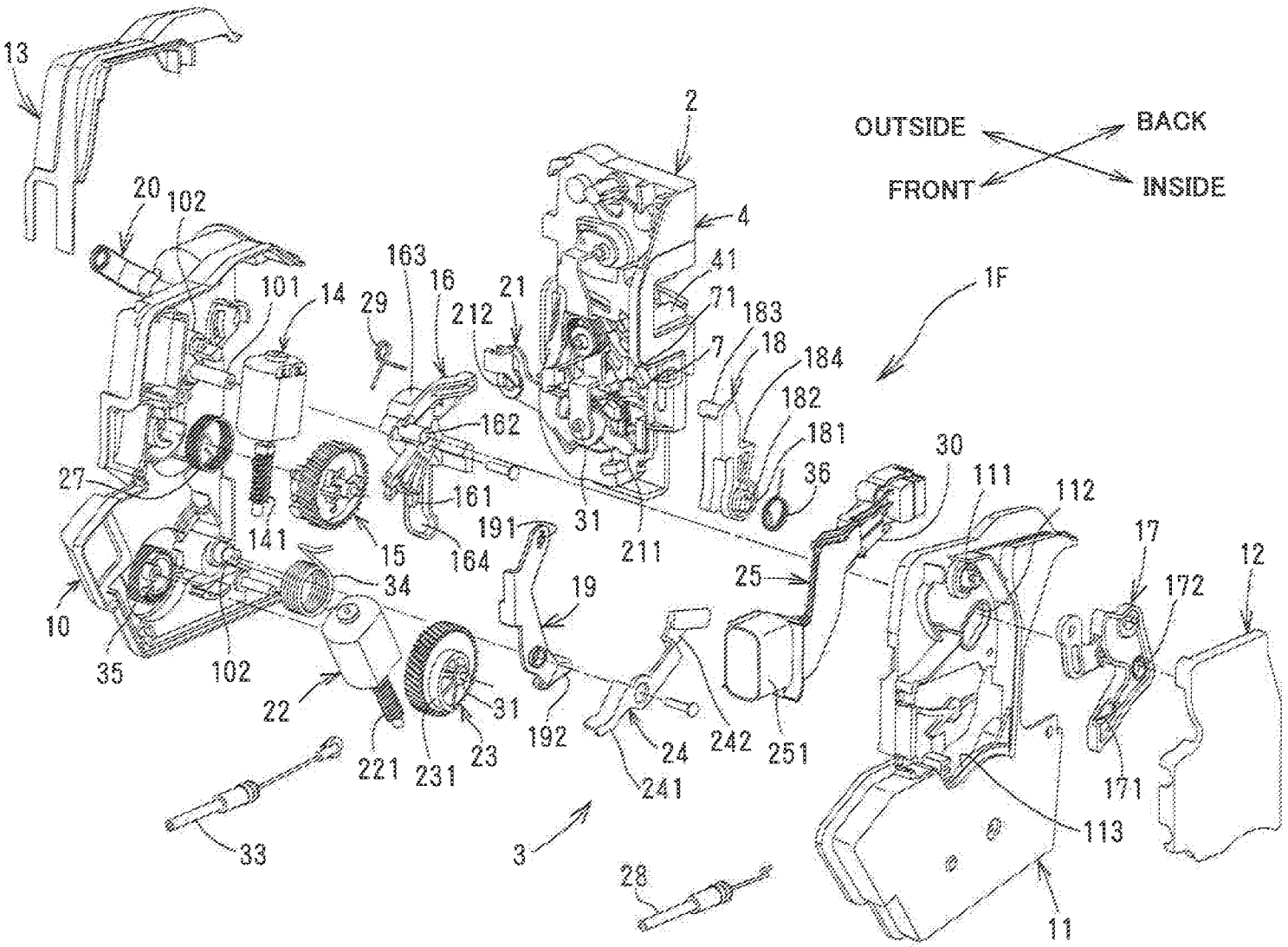
FIG. 5 is an exploded perspective view of the door latch device thereof.
Figure 6:
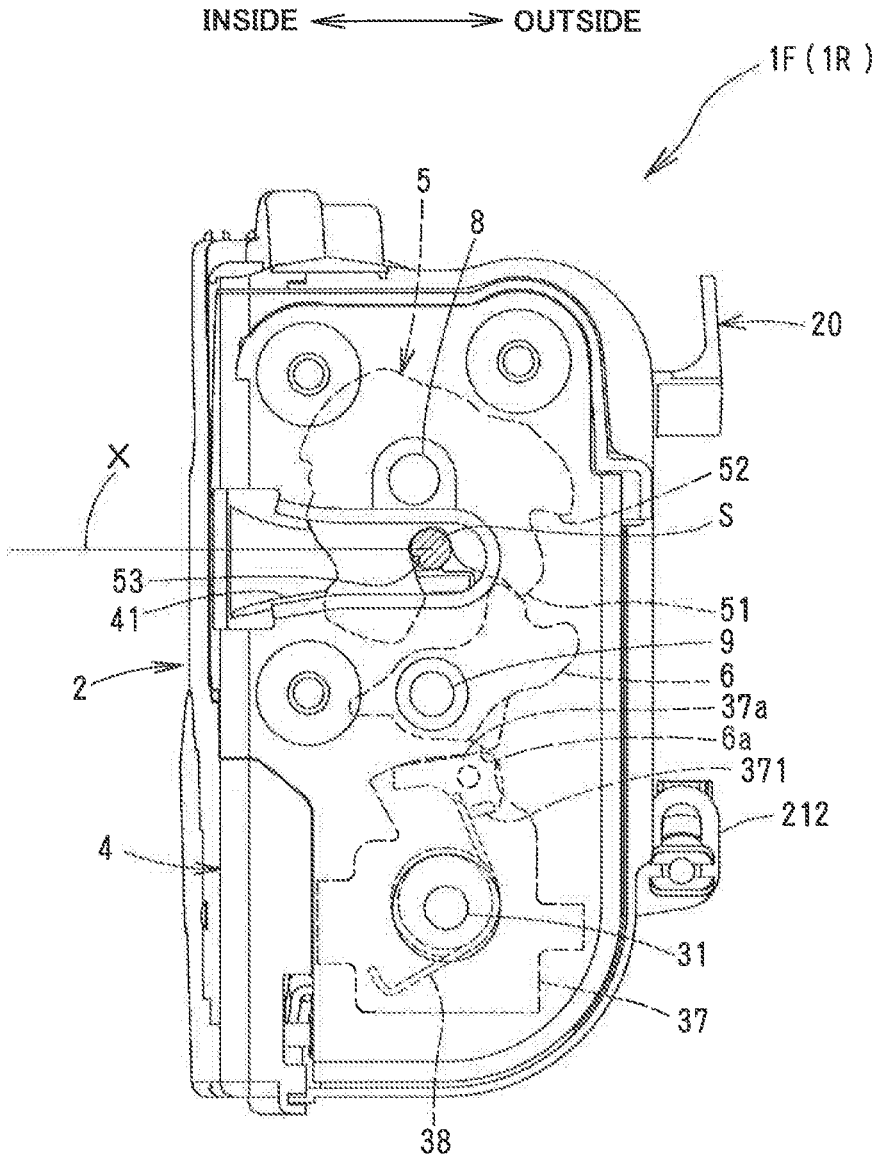
FIG. 6 is a back elevational view of the door latch device the same in each of the Designs.

FIGS. 2 and 3 are perspective views of the door latch device 1F common to the Designs; FIG. 4 is a partially exploded perspective view of the door latch device 1F in the Design 1; FIG. 5 is an exploded perspective view of the door latch device 1F in the Design 1; FIG. 6 is a back elevational view of the door latch device 1F common to the Designs; and FIGS. 7 to 11 are views showing an action of the main part in the Design 1.

The directions in the following description show states where the door latch devices 1F, 1R are attached in the doors FD, RD respectively.

The door latch device 1F comprises an engagement unit 2 with an engagement mechanism mounted in the front door FD for holding the front door FD closed by engaging with a striker S of the vehicle body; and an operating unit 3 with the locking mechanism comprising mechanical elements, such as a lever and a link, for shifting the front door FD to the lock state and the unlock state.

In FIG. 6, the engagement unit 2 mainly comprises a body 4 fixed to the rear end in the front door FD with a plurality of bolts (not shown); an engagement mechanism (not numbered) that includes a latch 5 that can engage with the striker S fixed to the vehicle body and a latch 6 that can engage with the latch 5 in the body 4; an opening lever 7 that can release the ratchet 6 from the latch 5 in FIGS. 4 and 5; and a metal inertia lever 37 that is pivotally mounted via a shaft 31 that lies longitudinally of the vehicle and supports an outside lever 21 later described.

The latch 5 is pivotally mounted in the body 4 via a latch shaft 8 that lies longitudinally of the vehicle, and comprise a full-latch engagement portion 51 and a half-latch engagement portion 52 that can engage with the ratchet 6, and engagement groove 53 that can engage with the striker S which enters a striker-entering groove 41 of the body 4.

In FIG. 6, the striker-entering groove 41 of the body 4 is formed slightly higher than the middle vertically and is open toward the inside of the vehicle to extend outwardly of the vehicle. The symbol "X" in FIG. 6 shows a striker entering line along which the striker S comes into the striker-entering groove 41 and engages with the engagement groove 53 of the latch 5 when the front door FD closes.

With closing of the front door ED, the latch 5 rotates from an open position (a position where it rotates clockwise from FIG. 6 by approximately 90 degrees) where the latch 5 does not engage with the striker S and the front door FG is open, to a full-latch position in FIG. 6 where the striker S fully engages with the engagement groove 53 to fully close the front door FD, via a half-latch position where the latch 5 rotates counterclockwise by a certain angle against a spring (not shown) to make the engagement groove 53 slightly engages with the striker S which comes into the striker-entering groove 41 along the striker-entering line X from the left. The striker S leaves the striker-entering groove 41 with opening of the front door FD, and the latch 5 rotates vice versa.

The ratchet 6 is pivotally mounted under the striker-entering groove 41 within the body 4 via a ratchet shaft 9 that lies longitudinally of the vehicle and is urged by a spring (not shown) in an engaging direction (counterclockwise in FIG. 6 to engage the ratchet 6 with the full-latch engagement portion 51 and the half-latch engagement portion 52 of the latch 5). The ratchet 6 engages with the full-latch engagement portion 51 for holding the front door FD fully closed, and engages with the half-latch engagement portion 52 for holding the front door FD not completely closed.

The inertia lever 37 is pivotally mounted via a shaft 31 such that a center of gravity is positioned at the center of the shaft 31, and is urged any time clockwise by a spring 38 in which one end engages with a projection 371 on a front face, so that the inertial lever 37 is at rest in a standby position in FIG. 6. On a side opposite a side where one end of the spring 38 engages with the projection 371, an outward end of the opening lever 7 that rotates with the ratchet 6 abuts. (not shown)

Thus, when a force of inertia for turning the ratchet 6 in a releasing direction (clockwise in FIG. 6) is exerted by a side crash, a lower end 6*a* of the ratchet 6 immediately comes in contact with an upper end 37*a* of an inertial lever 37 which is at rest in a standby position, thereby blocking the ratchet 6 from turning in the releasing direction. So, at the crash, the ratchet 6 unlikely leaves the latch 5, and the latch 5 still engages with the ratchet 6, thereby preventing the front door FO from opening unexpectedly at the crash. In order to prevent the ratchet 6 from rotating in the releasing direction securely, a line of action when the lower end 6*a* of the ratchet 6 contacts the upper end 37*a* of the inertial lever 37 may preferably go through a center of the shaft 31.

When the opening lever 7 and the ratchet 6 are rotated by an outside lever 34 (later described) in the releasing direction, the end of the opening lever 7 comes in contact with the projection 371 counterclockwise in FIG. 6, and the inertial lever 37 is rotated counterclockwise against the spring 38. The upper end of the inertial lever 37 goes out of a moving path of the lower end 6*a* of the ratchet 6 to allow the ratchet 6 to rotate in the releasing direction (clockwise in FIG. 6), so that the front door FD can be opened.

In FIG. 5, the opening lever 7 is pivotally mounted coaxially with the ratchet 6 on a front face of the body 4 to rotate together with the ratchet 6, and a released portion 71 is disposed at the end extending toward the interior of the vehicle.

Then, an operating unit 3 will be described as below.

The operating unit 3 comprises a first L-shaped synthetic-resin cover 10 fixed to the body 4 to cover a front surface of the body 4; a second synthetic-resin cover 11 that closes a side of the first cover 10 facing the interior of the vehicle; a synthetic-resin waterproof side cover 12 that closes an upper half of the second cover 11 from the interior of the vehicle; a waterproof top cover 13 that covers a top joining surface of the first cover 10 and the second cover 11; and an operating mechanism (not numbered) in the housing.

"In the housing" in the description denotes a storage space formed between a side of the first cover 10 perpendicular to a front face of the body 4 and a side of the second cover 11 opposite the side of the first cover 10.

In FIG. 5, the operating mechanism comprises, as basic elements, a locking motor 14; a locking worm wheel 15 (locking rotor) reversible by the locking motor 14; a locking lever 16 movable between an unlock position for allowing the front door FD to open and a lock position for keeping the front door from opening; an opening link 18 movable with the locking lever 16 between the unlock position and the lock position; an inside lever 19 in the Design 1 connected to the inside handle IH of the front door FD; a key lever 20 (no provided in the rear-door door latch device 1R) cooperating with the key cylinder KC for the front door FD; an outside lever 21 connected to the outside handle OH for the front door FD; a releasing motor 22; a releasing worm wheel 23 (releasing rotor) that can be rotated by the releasing motor 22; an electric releasing lever 24 that can be released (rotated clockwise in FIG. 7) with rotation of the releasing worm wheel 23; a locking motor 14; and a distribution plate 25 with circuits electrically connected to the locking motor 22, the releasing motor 22 and detecting switches. In a storage space between the second cover 11 and the waterproof side cover 12, there is provided a knob lever 17 connected to a locking knob (not shown) on the front door FD inside the vehicle.

The inside lever 19 of the internal operating system is set in each Design as below. The operating mechanism of the operating unit 3 comprises elements except the inside lever 19 (including the key lever 20 in the rear-door door latch device 1R) from the basic elements.

In this embodiment, the locking worm wheel 15, the locking lever 16 and the knob lever 17 as mechanical elements constitute the locking mechanism.

"An unlock state" in the following description means that the locking lever 16, the knob lever 17 and the opening link 18 are in an unlock position respectively, and "a lock state" means that the locking lever 16, the knob lever 17 and the opening link 18 are in a lock position respectively. The locking mechanism is not limited to this embodiment, but the locking lever 16 may be connected to the locking knob without the knob lever 17.

The releasing motor 22, the releasing worm wheel 23 and the electric release lever 24 form an electric releasing mechanism.

The locking motor 14 is held in the housing, and a case 14*a* (yoke) is above a striker-entering line X in FIG. 6. An output shaft 14*b* pivotally mounted to the case 14*a* is disposed downward and driven with a switch (not shown) on the interior of the vehicle or an electronic key of a user.

The locking motor 14 is disposed in the housing such that the case 14*a* is above the striker-entering line X. So rainwater through the striker-entering groove is prevented from coming into the case 14*a*.

The distribution plate 25 is integrally formed with a coupler 251 connected to an external connector or wire (not shown) connected to a vehicle battery (not shown) and an ECU. At a side of the distribution plate 25 opposite the outside of the vehicle, electric circuits for supplying power and signals into the housing are fixed in the housing to cover the case 14*a* of the locking motor 14 from the inside of the vehicle. The distribution plate 25 is electrically connected to terminals of the locking motor 14 and the releasing motor 22, and to the external connector connected to the coupler 251 so that the locking motor 14 and the releasing motor 22 may be controlled by the ECU. FIG. 4 clearly illustrate an internal structure of the operating unit 3 without the distribution plate 25.

The locking worm wheel 15 is pivotally mounted in the housing via a shaft 26 that lies transversely of the vehicle below the case 14*a* of the locking motor 14 and meshes with a worm 141 mounted on an output shaft 14*b* of the locking motor 14. Thus, the worm wheel 15 is rotated clockwise or counterclockwise by the locking motor 14 from a neutral position (such as in FIG. 7) against of a spring 27 (in FIG. 5) wound on the shaft 26, and returns to the neutral position again from a position where the worm wheel 15 is rotated by the spring 27 when the locking motor 14 stops.

The knob lever 17 is pivotally mounted to a side of the second cover 11 via a shaft 111, and a connecting arm 171 that extends downward is connected to a manually-operating locking knob via a connecting member 28 comprising a Bowden cable. So, based on an unlocking action and a locking action of the locking knob, the knob lever 17 rotates counterclockwise from an unlock position in FIG. 7 to a lock position in FIG. 8. An action of the locking knob is transmitted to the locking lever 16 and the opening link 18 via the knob lever 17.

After the knob lever 17 is connected to the second cover 11 in FIG. 3, the waterproof side cover 12 is fixed to an outer side of the second cover 11, and the second cover 11 that includes an area where the knob lever 17 is disposed is partially closed thereby preventing rainwater from coming into the housing.

The locking lever 16 is pivotally mounted in the housing via a shaft 101 that projects inward of the vehicle from an inner surface of the first cover 10, and teeth 161 of the locking lever 16 mesh with teeth 151 of the locking worm wheel 15. An upper part of the locking lever 16 is joined to the key lever 20, and a connecting projection 162 at an upper front part is connected to a connecting hole 172 of the knob lever 17 through an arc-shaped hole 112 of the second cover 11. The locking lever 16 has an arm 164 with a guide wall 165 that extends downward from a center of rotation. A shaft 101 or a center of rotation of the locking lever 16 is disposed above the striker-entering line X in the housing.

Figure 7:
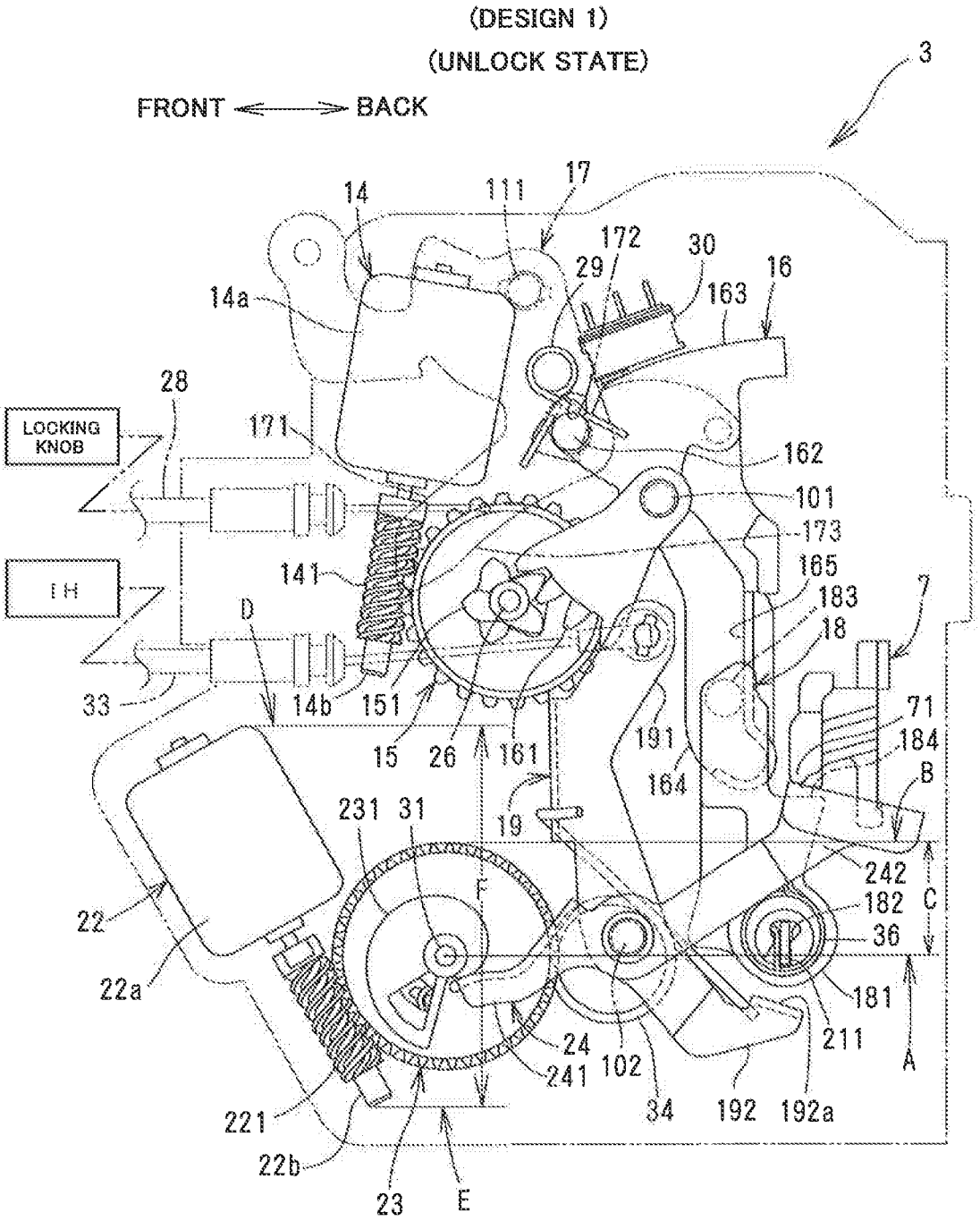
FIG. 7 is a side elevational view of a main part when the locking mechanism is in the unlock state in the Design 1.
Figure 8:
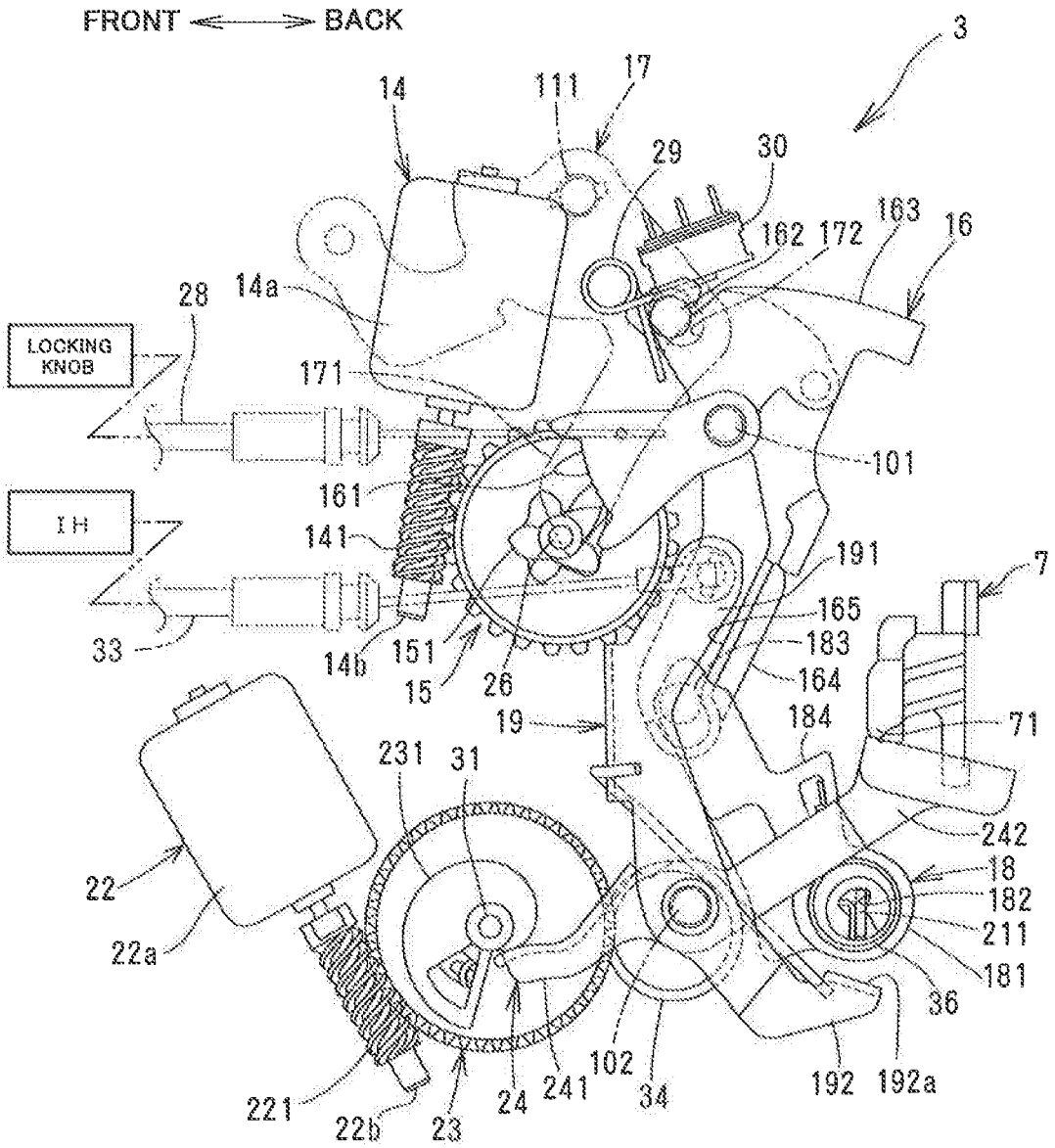
FIG. 8 is a side elevational view of the main part when the locking mechanism is in the lock state.
Figure 9:
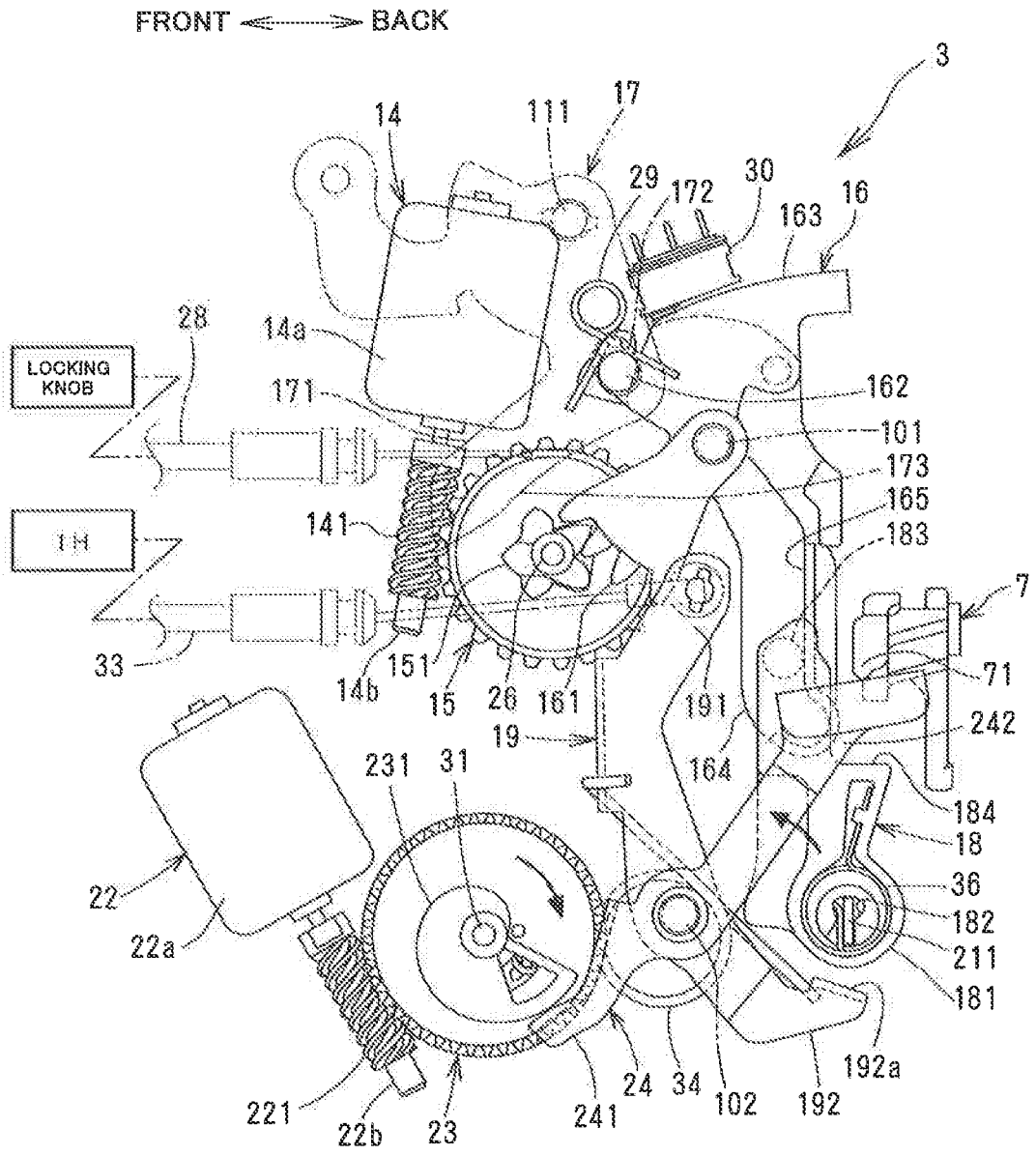
FIG. 9 is a side elevational view when the locking mechanism is electrically released in the unlock state.

Thus, according to rotation of the key lever 20 with the key cylinder, rotation of the knob lever 17 with the locking knob and rotation of the locking worm wheel 15 with the locking motor 14, the locking lever 16 can rotate from an unlock position in FIG. 7 to a lock position in FIG. 8 to which the locking lever 16 rotates clockwise by a certain angle from the unlock position and is elastically held by an elastic holding force of a holding member 29 in the unlock and lock positions respectively. When the locking worm wheel 15 is at a neutral position, the teeth 161 of the locking lever 16 do not engage with the teeth 151 of the locking worm wheel 16, so that rotation of the locking lever 16 with the locking knob and the key cylinder is not transmitted to the locking worm wheel 15.

The holding member 29 comprises a torsion spring a coil of which is supported by a cylindrical support 102 (in FIG. 5) integrally formed with an inner surface of the first cover 10. Both the arms hold the connecting projection 162 of the locking lever 16. So, when the locking lever 16 rotates from the unlock position (or lock position) to the lock position (or unlock position), an urging direction is converted from the unlock direction (or lock direction) to the lock direction (or unlock direction) with respect to an intermediate position between the unlock position and the lock position.

The locking lever 16 stops at the unlock position and the lock position by contacting a part of the locking lever 16 to a rubber stopper (not shown) fixed to the inner surface of the first cover 10.

On an upper circumference of the locking lever 16, there is formed a cam surface 163 which contacts a detecting portion of a detecting switch 30 of the distribution plate 25. The detecting switch 30 is in sliding contact with the cam surface 163 relatively, thereby supplying a signal corresponding to the unlock state/lock state of the locking mechanism. The outputted signal is transmitted to the ECU via the circuits on the distribution plate 25.

The opening link 18 has a connecting hole 182 in a lower rotary portion 181, and a flat connecting portion 211 at the end of the outside lever 21 is inserted into the connecting hole 182. Hence, the opening link 18 is coupled to the connecting portion 211 of the outside lever 21 to rotate by a certain angle, and an upper coupling projection 183 is coupled to the arm 164 of the locking lever 16. With a motion of the locking lever 16 between the unlock position and the lock position, the opening link 18 rotates from an unlock position in FIG. 7 to a lock position in FIG. 8 to which the opening link 18 rotates clockwise by a certain angle from the unlock position.

Furthermore, in the middle, the opening link 18 has a releasing portion 184 which can contact the released portion 71 of the opening lever 7 from below, in the unlock position in FIG. 7. A torsion spring 36 is disposed in the rotary portion 181 of the opening link 18.

One end of the torsion spring 36 engages with the opening link 18, and the other end engages with the connecting portion 211 of the outside lever 21. So, an urging force is applied to the opening link 18 anytime in the unlocking direction (clockwise in FIG. 7) around the connecting portion 211 of the outside lever 21. The torsion spring 36 is set to be smaller than a holding force for elastically holding the locking lever 16 of the holding member 29 in the lock position.

The coupling projection 183 of the opening link 18 is connected to the arm 164 of the locking lever 16 such that the coupling projection 183 of the opening link 18 can slide vertically along the arm 164 of the locking lever 16 and can contact the guide wall 165 only when the locking lever 16 rotates in a locking direction (counterclockwise in FIG. 7).

In the unlock state in FIG. 7, when the locking lever 16 rotates to the lock position, the opening link 16 rotates from the unlock position to the lock position in FIG. 8 by contacting the guide wall 165 of the locking lever 16 with the coupling projection 183 of the opening link 18. In the lock state in FIG. 8, when the locking lever 18 rotates to the unlock position, the opening link 18 rotates from the lock position to the unlock position in FIG. 7, following a rotation of the locking lever 16 by the torsion spring 36 without depending on contact relationship between the guide wall 165 and the coupling projection 183.

In the lock state in FIG. 8, the torsion spring 36 exerts on the locking lever 16 in an unlocking direction (clockwise). The torsion spring 36 is smaller than elastic holding force for holding the locking lever 16 in the lock position with the holding member 29. Thus, the locking lever 16 and the opening link 18 are not rotated to the unlock position by the torsion spring 36.

The outside lever 21 is pivotally mounted vertically at a front lower part of the body 4 via the shaft 31 which lies longitudinally of the vehicle, and the connecting portion 211 is connected to the opening link 18 as above. A connecting portion 212 at the inner end is connected to the outside handle OH via a vertical connecting member (not shown). Based on a door-opening action of the outside handle OH, the outside lever 21 rotates against the urging force of a spring (not shown) in a releasing direction (counterclockwise in FIG. 5) by a certain angle thereby applying a releasing action to the opening link 18.

In the housing, a case (yoke) 22*a* of the releasing motor 22 is below the striker entering line X, and an output shaft 22*b* pivotally mounted to the case 22*a* is disposed backward and downward. The regular user with the electronic key comes within a predetermined area around the motor vehicle V, and an ID signal is matched through wireless communication conducted between the electronic key and a receiver in the motor vehicle V. When it is authenticated that the regular user comes around the motor vehicle V, the releasing motor 22 is driven by turning on the detecting switch SW because the user contacts or approaches the detecting switch SW.

Because the releasing motor 22 is disposed below the striker-entering line X, rainwater that comes through the striker-entering groove 41 likely attaches to the releasing motor 22, but the output shaft 22*b* of the releasing motor 22 is disposed obliquely backward and downward. So rainwater that comes into the case 22*a* can be minimized.

The releasing worm wheel 23 is like a disc and is pivotally mounted in the housing via the shaft 31 which lies transversely of the vehicle. The worm wheel 23 meshes with a worm 221 fixed to the output shaft 22*b* pivotally mounted to the case 22*a* of the releasing motor 22. Based on the drive of the releasing motor 22, the worm wheel 23 is rotated clockwise by a certain angle from a set position (such as a position in FIG. 7) against an urging force of the spring 35 (in FIG. 5) wound on the shaft 31 to the position in FIG. 9. The releasing motor 22 stops rotation and returns to the set position again from a position where it is rotated by the spring 35. In the releasing worm wheel 23, there is formed a cam surface 231 in an involute curve in which a distance from an axis to an outer circumference gradually increase counterclockwise in FIG. 7.

The shaft 31 for mounting the releasing worm wheel 23 pivotally is below the case 22*a* of the releasing motor 22 and disposed behind the output shaft 22*b*.

An electric release lever 24 is pivotally mounted via a shaft 102 (release shaft) in the middle in the housing, and comprises a first arm 241 in which a front end can come in sliding contact with a cam surface 231 of the releasing worm wheel 23 and a second arm 242 in which a rear end can come in contact with a released portion 71 of the opening lever 7 from below.

In the housing, the shaft or a center of rotation of the electric release lever 24 is disposed below an upper half of the case 22*a* and the striker-entering line X behind the shaft 31 in front of the opening lever 7.

For example, in FIG. 7, when the releasing worm wheel 23 is in the set position, the end of the first arm 241 of the electric release lever 24 comes in contact with a smaller-diameter portion of a cam surface 231 of the releasing worm wheel 23, and the electric release lever 24 is held in a set position in FIG. 7. The releasing worm wheel 23 is rotated clockwise by a certain angle by the releasing motor 22 from the set position in FIG. 7 to a release position in FIG. 9. The end of the first arm 241 of the electric release lever 24 slides on the cam surface 231 to a larger-diameter portion of the cam surface 231, and the electric release lever 24 rotates to the release position in FIG. 9. The end of the second arm 242 comes in contact with the released portion 71 of the opening lever 7 from below to make the opening lever 7 release, and the ratchet 6 disengages from the latch 5, so that the front door FD can be opened.

When the regular user with the electronic key comes within a predetermined area around the car V and it is authenticated that the regular user approaches the car V by identification through a wireless communication between the electronic key and the receiver in the car V, the ECU makes the detecting switch usable, turns on the detecting switch SW by contacting or approaching the detecting switch SW and controls the releasing motor 22 to enable the front door FD to open. When the locking mechanism is in the lock state, the locking motor 14 is controlled and shifted to an unlock state after the releasing motor 22 stops driving.

A position of each element that constitutes a basic structure of the operating mechanism is set as below:

1) The shaft 101 as a center of rotation of the locking lever 16 and the case 14*a* for the locking motor 14 are disposed above the striker entering line X.
2) The shaft 102 as a center of rotation of the electric release lever 24, the shaft 31 as a center of rotation of the releasing worm wheel 23 and the case 22*a* for the releasing motor 22 are disposed below the striker-entering line X.
3) In FIG. 7, if a straight line extending backward from an axis of the shaft 31 is a straight line A, if a straight line extending backward from the top of an outer circumference of the releasing worm wheel 23 is a straight line B, if a range C is between the straight lines A and B, if an extension line backward from the upper end of the releasing motor 22 is a straight line D; if an extension line backward from the lower end of the releasing motor 22 is a straight line E, and if a range F is between the straight line D and the straight line E, the releasing worm wheel 23 is within the range F, and the shaft 102 is behind the releasing worm wheel 23 and in front of the opening link 18 and the opening link 7 within the range C.

The locking mechanism and an electric release mechanism are disposed above and below the striker-entering line X respectively in the housing, and each of the elements can be arranged orderly. Because the shaft 102 is located at the foregoing position, the releasing motor 22, the releasing worm wheel 23 and the electric release lever 24 can be arranged longitudinally of the vehicle to minimize downward projections, thereby making the housing smaller and, in turn, making the door latch device 1F smaller.

(Basic Action of the Door Latch Device 1F)

Then, basic movements of the door latch device 1F will be described.

<When a Regular User With an Electronic Key Opens the Front Door FD Outside the Vehicle in an Unlock State.>

When the front door is fully closed and the locking mechanism is in an unlock state, each element of the operating mechanism is held in FIG. 7.

In the unlock state in FIG. 7, when the ECU authenticates that the regular user with the electronic key approaches the car V, a finger of the regular user touches or approaches the detecting switch SW, and the ECU controls the releasing motor 22 to rotate the releasing worm wheel 23 from the set position in a releasing direction (clockwise in FIG. 7). With rotation of the releasing worm wheel 23 in the releasing direction, the end of the first arm 241 slides on the cam surface 231 of the releasing worm wheel 23, and the electric release lever 24 rotates from the set position to the releasing position in FIG. 9, and the end of the second arm 242 comes in contact with the released portion 71 of the opening lever 7 from below to make the opening lever 7 released. Thus, the engagement mechanism is released, and the front door ED can be opened.

<When the Regular User With the Electronic Key Opens the Front Door FD in the Lock State Outside the Vehicle>

When the front door FD is fully closed and the locking mechanism is in the lock state, the elements of the operating mechanism are held in FIG. 8.

Figure 10:
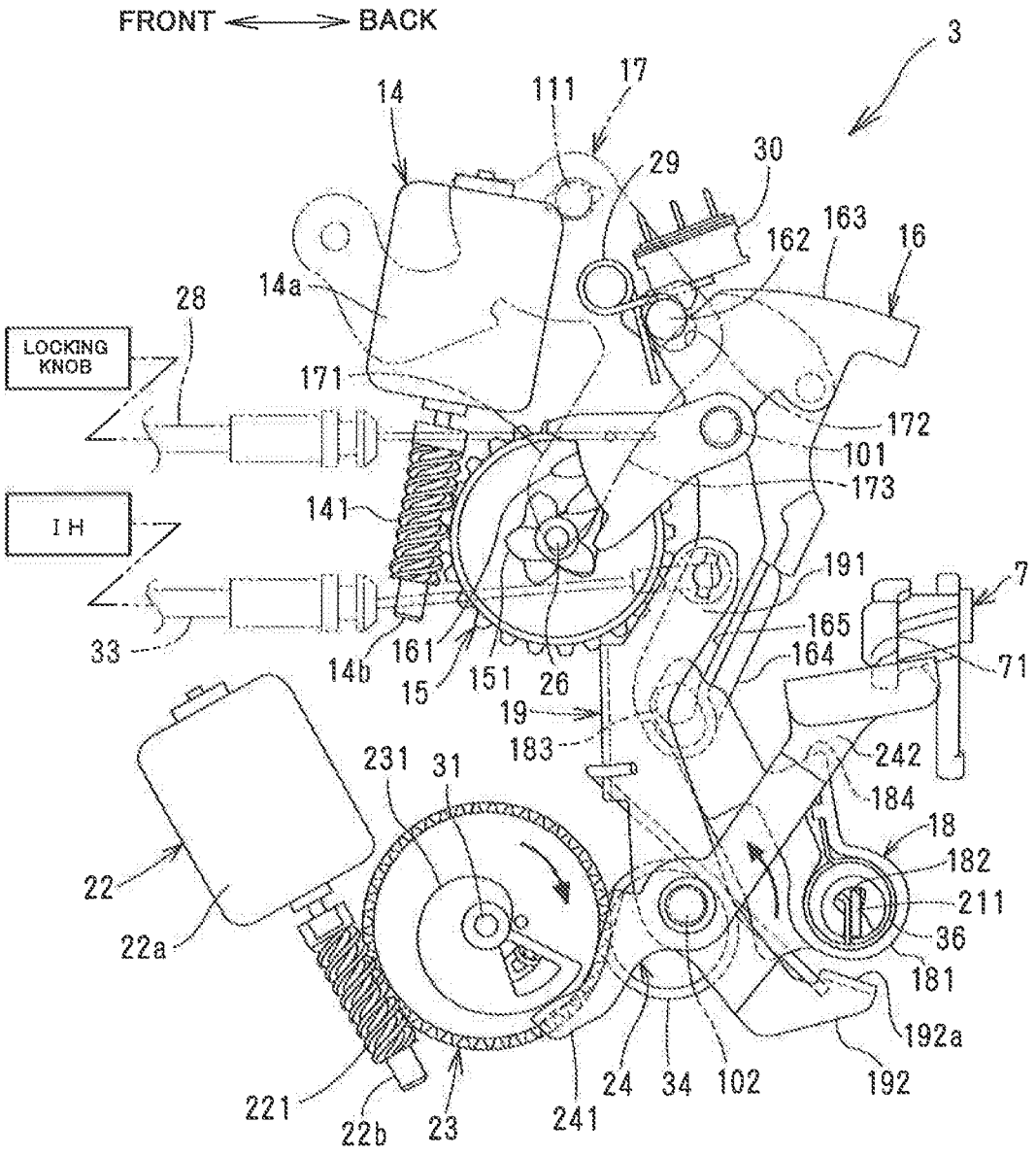
FIG. 10 is a side elevational view of the main part when the locking mechanism is electrically released in the lock state.

In the lock state in FIG. 8, when the ECU authenticates that the regular user with the electronic key approaches the car V, the regular user touches or approaches the detecting switch SW, and the releasing motor is controlled as well as the unlock state. In FIG. 10, the electric release lever 24 is released, and the front door FD can be opened. However, in this case, taking account of operating activity after the user who gets in the car closes the front door FD, the locking motor 14 is controlled to shift to the unlock state after the releasing motor 22 stops driving.

<When the User (Passenger) Without the Electronic Key Opens the Front Door ED Outside the Vehicle>

Whether the locking mechanism is in an unlock state or a lock state when the front door FD is fully closed, the ECU does not authenticate the regular user and the releasing motor cannot be driven even if the passenger without the electronic key operates the switch SW.

Thus, the passenger without the electronic key can open the front door FD by operating the outside handle OH of the front door FD only when the front door FD is in an unlock state.

Specifically, when the outside handle OH is operated to open the door, the door-opening action is transmitted via a connecting member (not shown) to the outside lever 21, which is released counterclockwise in FIG. 5. The opening link 18 connected to the connecting portion 211 of the outside lever 21 is released upward from the set position in FIG. 7. With the releasing action, the releasing portion 184 comes in contact with the released portion 71 of the opening lever 7 from below to release the opening lever 7. Thus, the ratchet 6 disengages from the full-latch engagement portion 51 of the latch 5, so that the front door FD can be opened.

In FIG. 8, when the locking mechanism is in the lock state, with releasing action of the outside lever 21 based on door-opening action of the outside handle OH, the opening link 18 rotates upward from the set position, but the releasing portion 184 of the opening link 18 moves from the set position across the released portion 71 of the opening lever 7 without contacting the released portion 91. The opening lever 7 cannot be released and the front door FD cannot be opened. Thus, in the lock state, the passenger or another user without the electronic key cannot open the front door FD outside the vehicle.

The outside handle OH on the front door FD is also usable as outside mechanical operating element for opening the door in an emergency if the releasing motor 22 is incapable of driving due to failure in the releasing motor 22 or an electric system therefor. However, in case of the lock state, it is necessary to shift the locking mechanism to the unlock state with power of the locking motor 14 due to unlocking operation of the key cylinder KO and unlocking operation of the switch in the electronic key.

(Description of the Structure and Action in Each Design)

The structure and action of an internal operating system in each Design will be described.

<Design 1>

Figure 11:
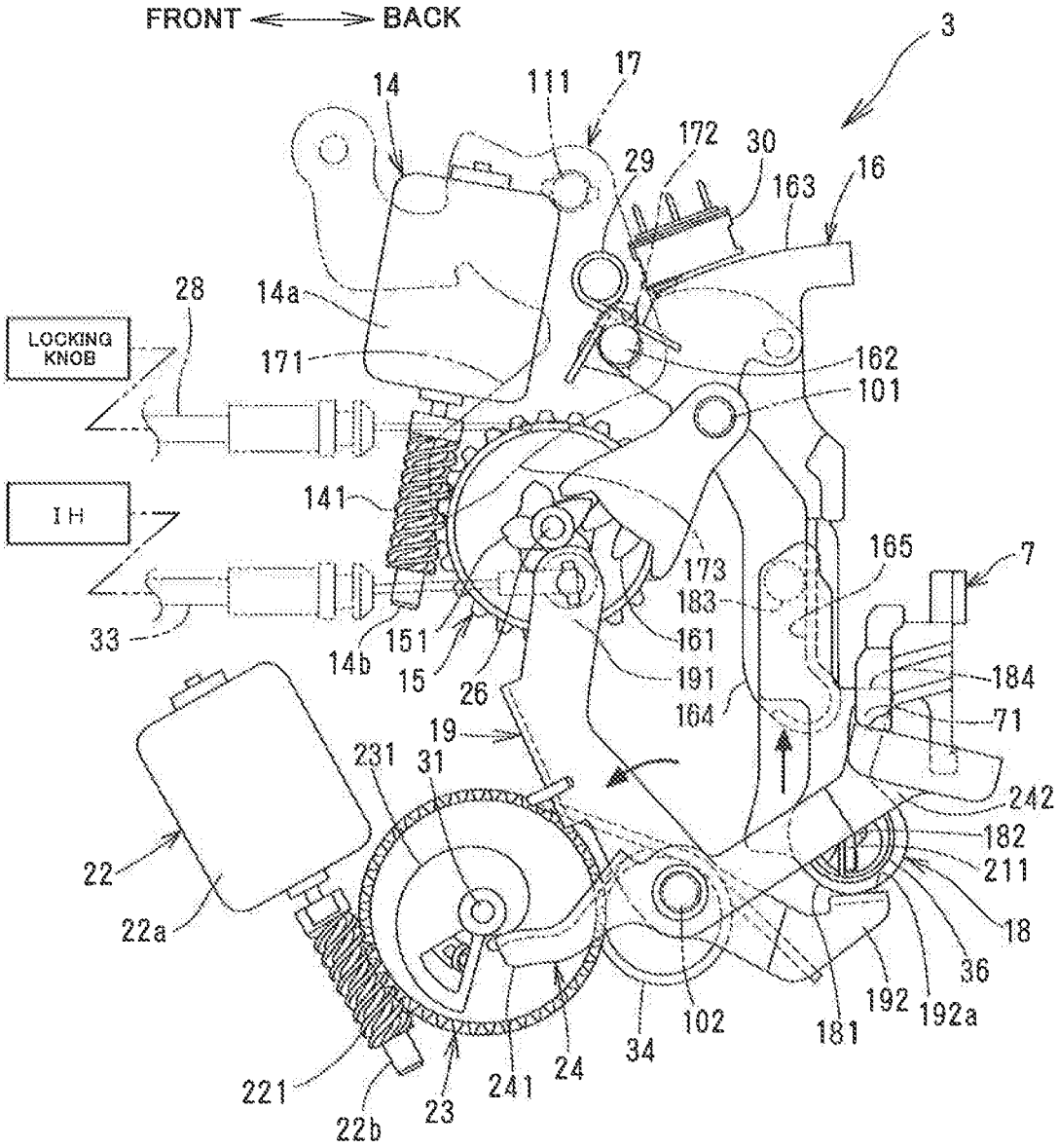
FIG. 11 is a side elevational view of the main part when the locking mechanism is manually released in the unlock state.

The internal operating system in Design 1 comprises the inside lever 19 as shown in FIGS. 7 to 11. In the housing, the inside lever 19 is pivotally mounted with the electric release lever 24 via the shaft 102 at a position slightly lower than the middle, and comprises a first arm 191 which extends upward and projects outwardly from an arc-shaped opening 113 (FIG. 3) and a second arm 192, and a second arm 192 which extends downward obliquely. An upper part of the first arm 191 is connected to the inside handle IH via a connecting member 33 such as a Bowden cable. Based on a door-opening action of the inside handle IH, the inside lever 19 rotates by a certain angle counterclockwise from the set position in FIG. 7 against an urging force of the spring 34 wound on the shaft 102, and is released as shown in FIG. 11. At the end of the second arm 192, there is formed a contact portion 192*a* which can come in contact with the rotary portion 181 of the opening link 18 when the inside lever 19 is released.

The connecting member 33 passes between the case 14*a* of the locking motor 14 located at an upper part of the housing and the case 22*a* of the releasing motor 22 located at a lower part, and is connected to the first arm 191 of the inside lever 19. So, the connecting member 33 is not over the cases 14*a*, 22*a* with a greater thickness transversely of the vehicle, thereby reducing a thickness along the width of the vehicle.

In the unlock state in FIG. 7, the door is tried to open by the inside handle IH. The door opening action is transmitted to the inside lever 19 via the connecting member 33. The inside lever 19 is released counterclockwise around the shaft 102 which is the same axis as the electric release lever 24. In FIG. 11, the contact portion 192*a* of the first arm 192 contacts the rotary portion 181 of the opening link 18 from below, thereby moving the opening link 18 upward. The releasing portion 184 of the opening link 18 contacts the released portion 71 of the opening lever 7 from below to release the engagement mechanism by rotating the opening lever 7 in a releasing direction to enable the front door FD to open.

In the lock state in FIG. 8, even if the inside lever 19 is released with the door-opening action of the inside handle IH and the opening link 18 is moved upward from the set position, the releasing portion 184 of the opening link 18 swings without contact with the released portion 71 of the opening lever 7, and the front door FD cannot be opened. In order to open the front door FD through the door-opening action of the inside handle IH in the lock state, the locking motor 14 is driven by an unlocking action of the locking knob inside the vehicle, or by a switch inside the vehicle. After turning to the unlock state, it is necessary to open the door with the inside handle IH.

Thus, in the door latch device 1F in the Design 1, when the locking mechanism is the lock state, the locking mechanism is shifted to the unlock state, and then, the inside lever 19 is rotated by the inside handle IH of the front door FD, so that the front door ED can be opened.

<Design 2>

Figure 12:
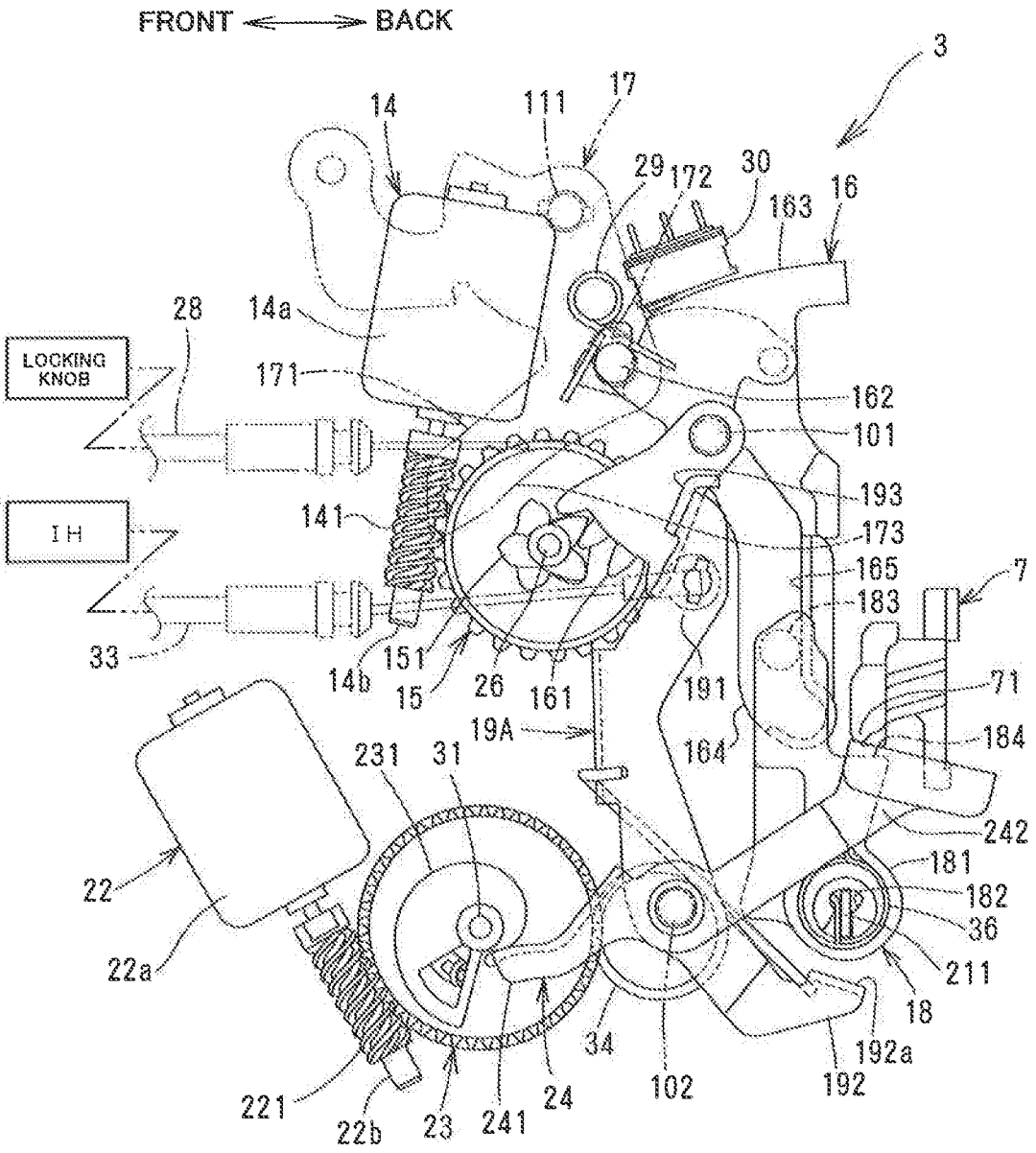
FIG. 12 is a side elevational view of the main part when the locking mechanism is in the unlock state in the Design 2.
Figure 13:
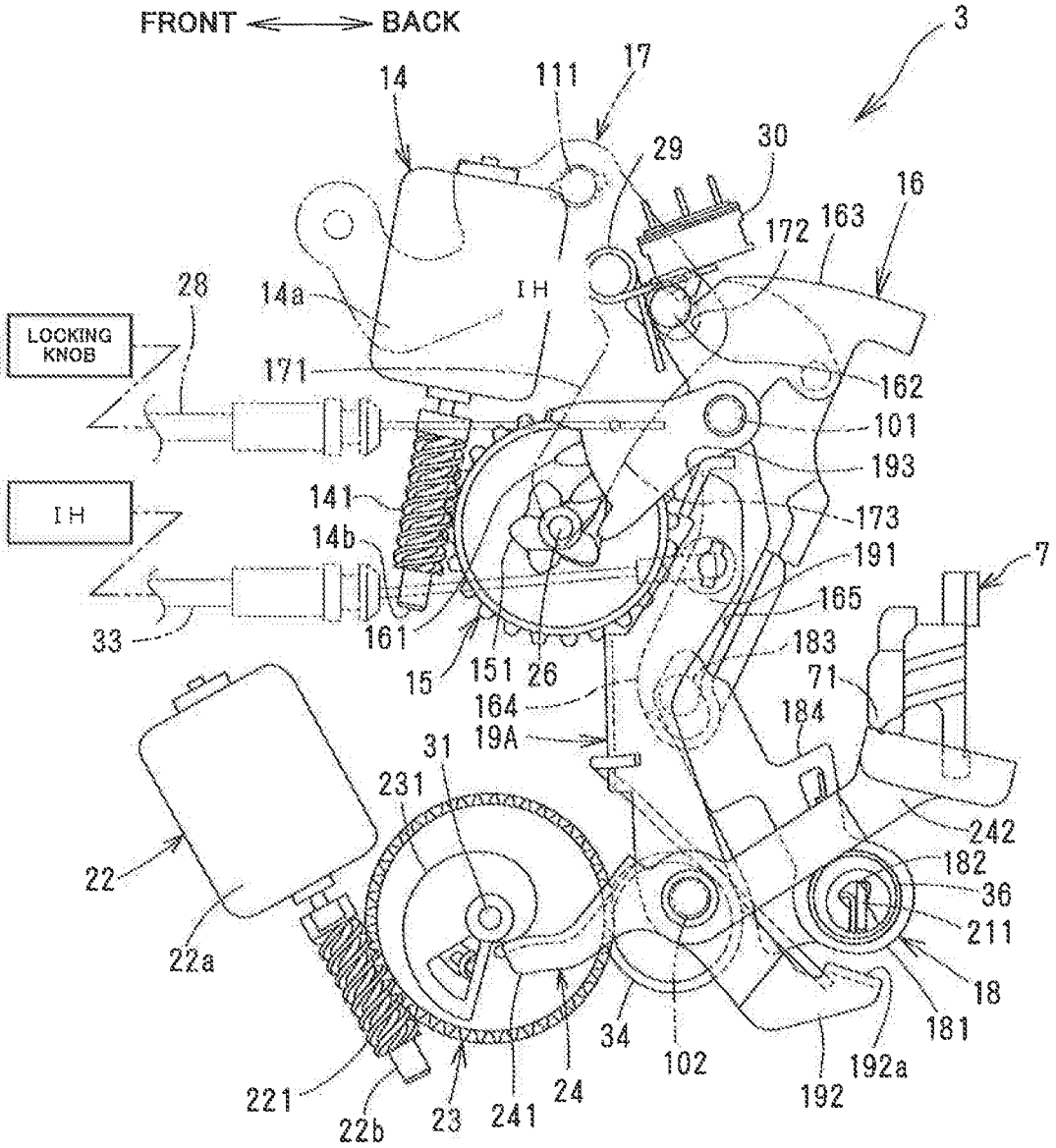
FIG. 13 is a side elevational view of the main part when the locking mechanism is the lock state.
Figure 14:
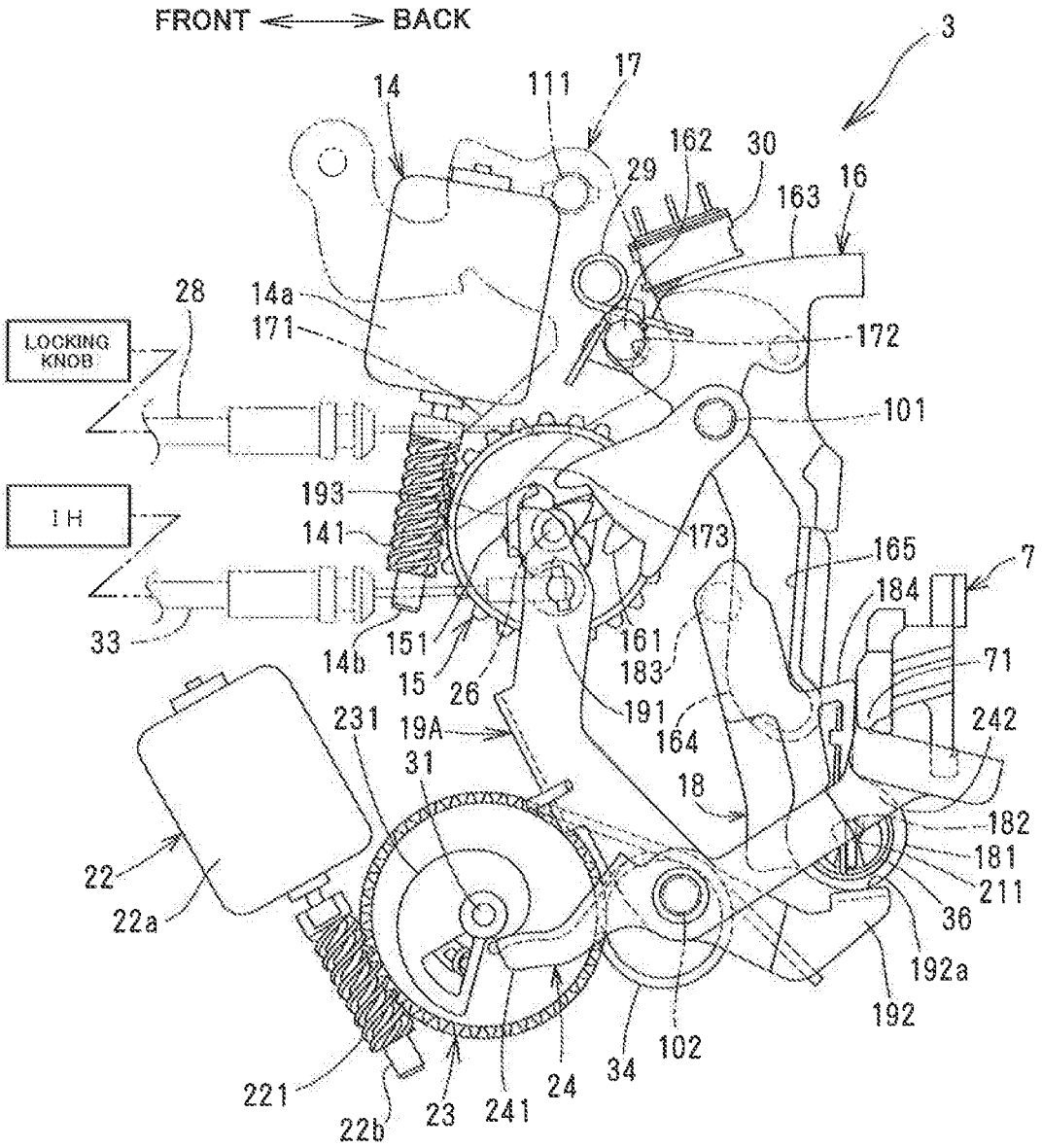
FIG. 14 is a side elevational view of the main part when the locking mechanism is manually released in the lock state.

An internal operating system in the Design 2 comprises an inside lever 19A in FIGS. 12 to 14. The inside lever 19A is pivotally mounted via a shaft 102 which is the same axis for the electric release lever 24 to form an unlocking portion 193 which is not formed in the inside lever 19 in the Design 1.

The unlocking portion 193 is formed on the upper end of the first arm 191 as a shape which can contact a part of the lower portion of the connecting arm 171 of the knob lever 17.

In the unlock state in FIG. 12, the door is tried to open by the inside handle IH to release the engagement mechanism to enable the front door FD to open with the same action as the Design 1.

In the lock state in FIG. 13, by a first door-opening action of the inside handle IH, the inside lever 19A rotates from the set position in FIG. 13 against the spring 34 (counterclockwise in FIG. 13). In FIG. 14, the inside lever 19A contacts a part 173 of the knob lever 17, and moves the locking lever 16 and the opening link 18 from the lock position to the unlock position.

With the releasing action of the inside lever 19A, the opening link 18 goes across upward in front of the released portion 71 of the opening lever 7 without contact, and the opening link 18 rotates with the locking lever 16 in an unlocking direction. So, in FIG. 14, part of the opening link 18 comes in contact with part of the opening lever 7 from a direction where the opening lever 7 is not capable of rotating, and an once-stop state occurs where the opening link 18 stops right before the unlock position.

In the door latch device 1F, when the locking lever 16 rotates from the unlock position to the lock position, the guide wall 165 of the locking lever 16 contacts the coupling projection 183 of the opening link 18 to move the opening link 18 to the lock position. But, when the locking lever 16 rotates from the lock position to the unlock position, the opening link 18 is rotated to the unlock position by the torsion spring 36 without depending on a contact relationship between the guide wall 165 and the coupling projection 183. Even if the once-stop state as above occurs, the locking lever 16 can rotate to the unlock position against the torsion spring 36 while the opening link 18 is still at rest in a position before the unlock position in FIG. 14.

In FIG. 14, the inside handle IH returns to a non-operating position once, and the opening link 18 moves downward, and part of the opening link 18 leaves part of the opening lever 7. The opening link 18 is moved to the unlock position by the torsion spring 36. Thus, the locking mechanism is completely shifted to the unlock state.

After shifting to the unlock state, the engagement mechanism is released by the inside handle IH again, so that the front door FD can be opened.

When the door latch device 1F in the Design 2 is in the lock state, the device is shifted to the unlock state by the first door-opening action of the inside handle IH, and the engagement mechanism is released by the second door-opening action of the inside handle IH, so that the front door FD can be opened.

<Design 3>

Figure 15:
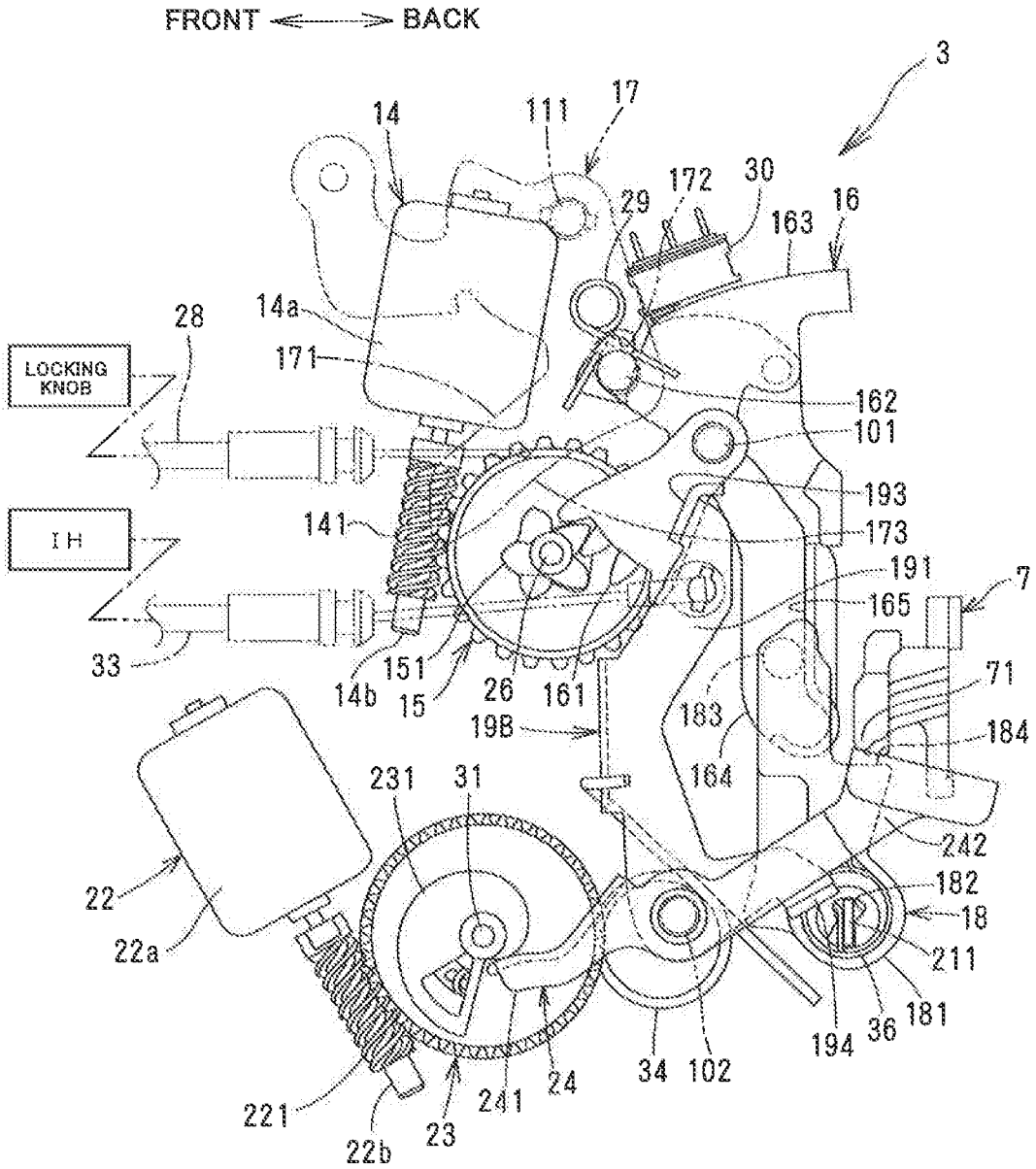
FIG. 15 is a side elevational view of the main part when the locking mechanism is in the unlock state in the Design 3.
Figure 16:
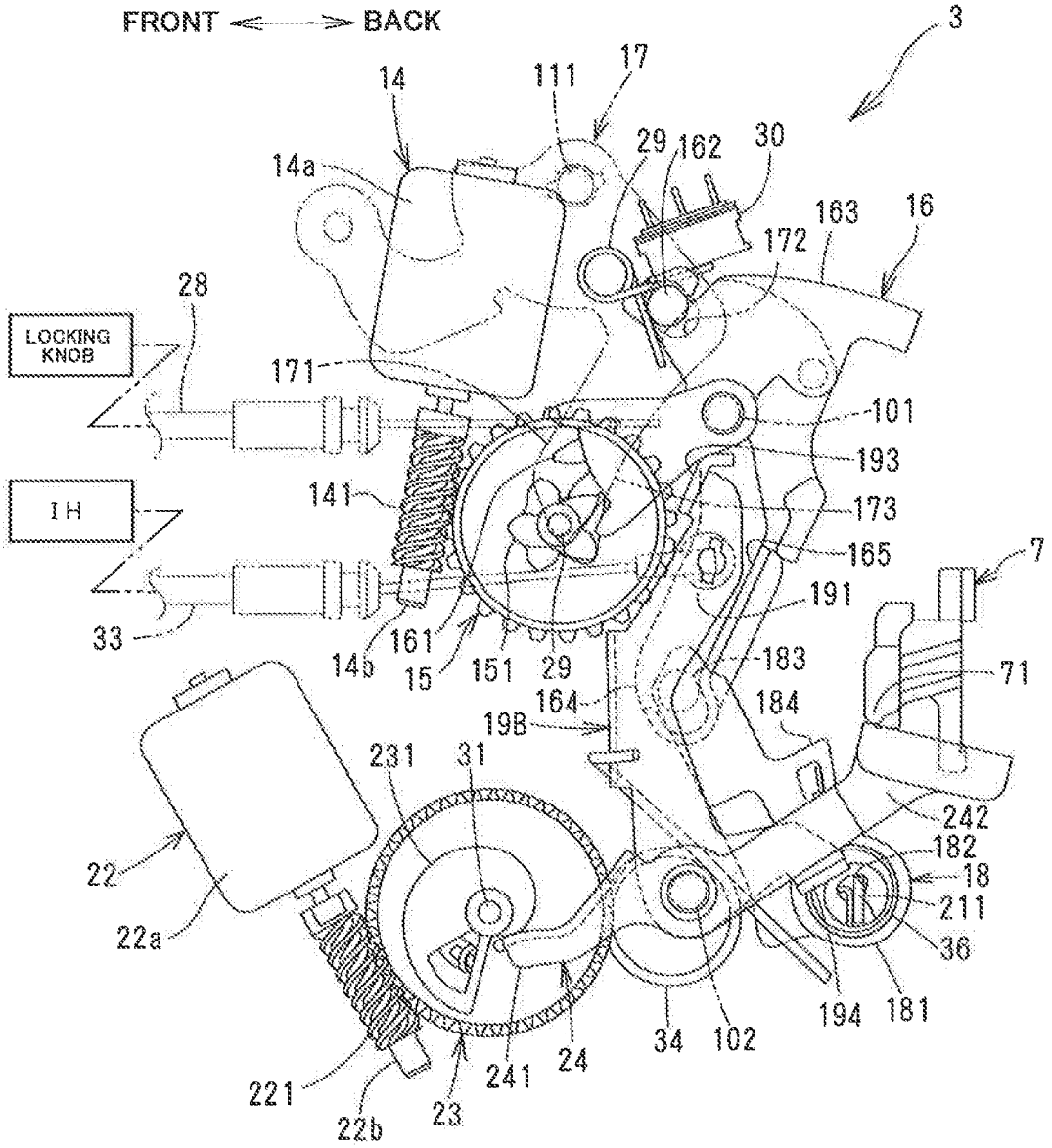
FIG. 16 is a side elevational view of the main part when the locking mechanism is in the lock state.
Figure 17:
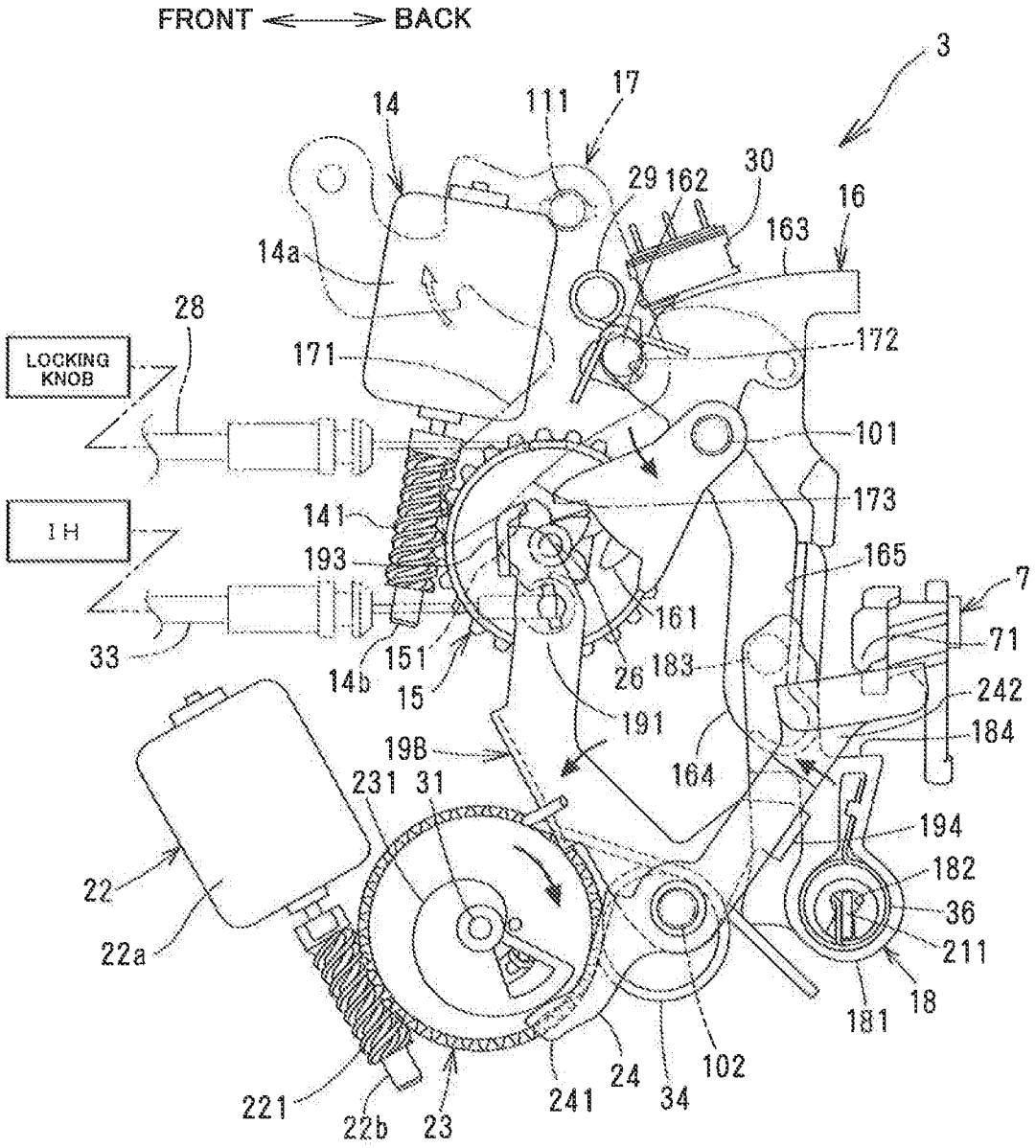
FIG. 17 is a side elevational view of the main part when the locking mechanism is manually released in the lock state.
Figure 18:
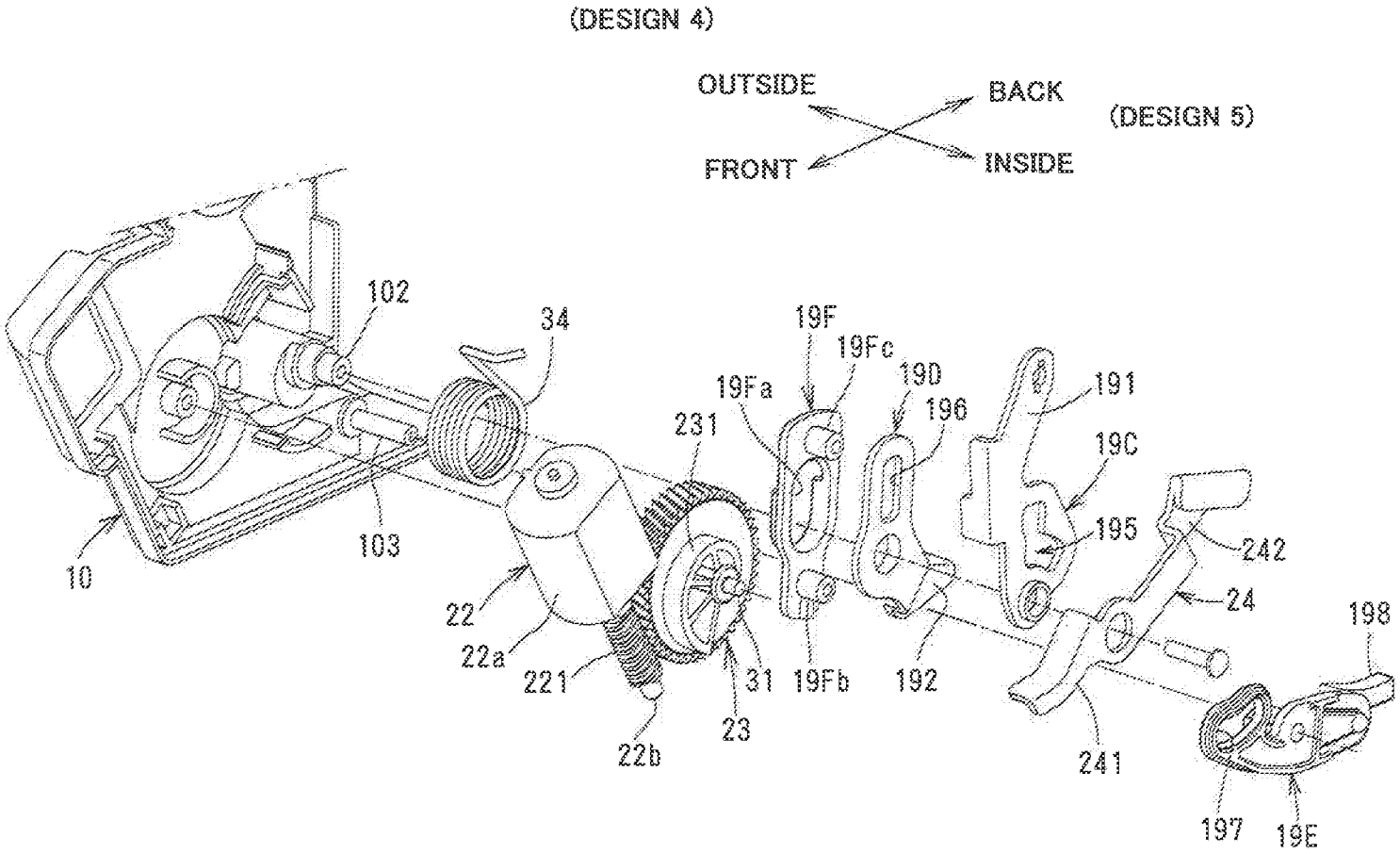
FIG. 18 is an exploded perspective view of the main part in the Design 4.

An internal operating system in the Design 3 comprises an inside lever 19B in FIGS. 15 to 17. The inside lever 19B is pivotally mounted via a shaft 102 which is coaxial with the electric release lever 24. An unlocking portion 193 (the same as the Design 2) and a releasing portion 194 which are not formed in the inside lever 19 in the Design 1 are formed, and the second arm 192 in the Design 2 is not formed.

The unlocking portion 193 which is the same as in the Design 2 is formed at the upper end of the first arm 191 and as a shape which can contact part 173 of the connecting arm 171 of the knob lever 17. The inside lever 19*b* is released (rotating counterclockwise in FIG. 15) based on a door-opening action of the inside handle IH, and the electric releasing portion 194 comes in contact with the second arm 242 of the electric release lever 24 counterclockwise to release the electric release lever 24.

In the unlock state in FIG. 15, when the door is tried to open by the inside handle IH, the inside lever 19B rotates by a certain angle counterclockwise from the set position around the shaft 102, and the electric releasing portion 194 comes in contact with the second arm 242 of the electric release lever 24 counterclockwise. The electric release lever 24 is moved counterclockwise around the shaft 102 from the set position in FIG. 15, and the end of the second arm 242 comes in contact with the released portion 71 of the opening lever 7, thereby releasing the engagement mechanism, so that the front door ED can be opened.

In the lock state in FIG. 16, when the door is tried to open by the inside handle IH, the inside lever 19B is released (rotation counterclockwise in FIG. 16) from the set position in FIG. 16 against the spring 34, and in FIG. 17, the unlocking portion 193 of the inside lever 19B comes in contact with part 173 of the knob lever 17 in FIG. 17. The locking lever 16 and the opening link 18 are moved from the lock position to the unlock position via the knob lever 17, and the electric releasing portion 194 comes in contact with the electric release lever 24 to release the electric release lever 24 counterclockwise, thereby releasing the engagement mechanism.

In the door latch device 1F in the Design 3, even if the locking mechanism is in the lock state, the locking mechanism is shifted to the unlock state by one-time opening action of the inside handle IH, and the engagement mechanism is released, so that the front door ED can be opened.

<Design 4>

The Design 4 is set to a door latch device 1R for a rear door. In FIGS. 18 to 21, besides a first inside lever 19C and a second inside lever 19D in the internal operating system, there is provided a childproof mechanism that comprises a childproof operating lever 19E and a connect link 19F.

The first and second inside levers 19C, 19D are pivotally mounted via the shaft 102 which is the same axis for the electric release lever 24.

Figure 19:
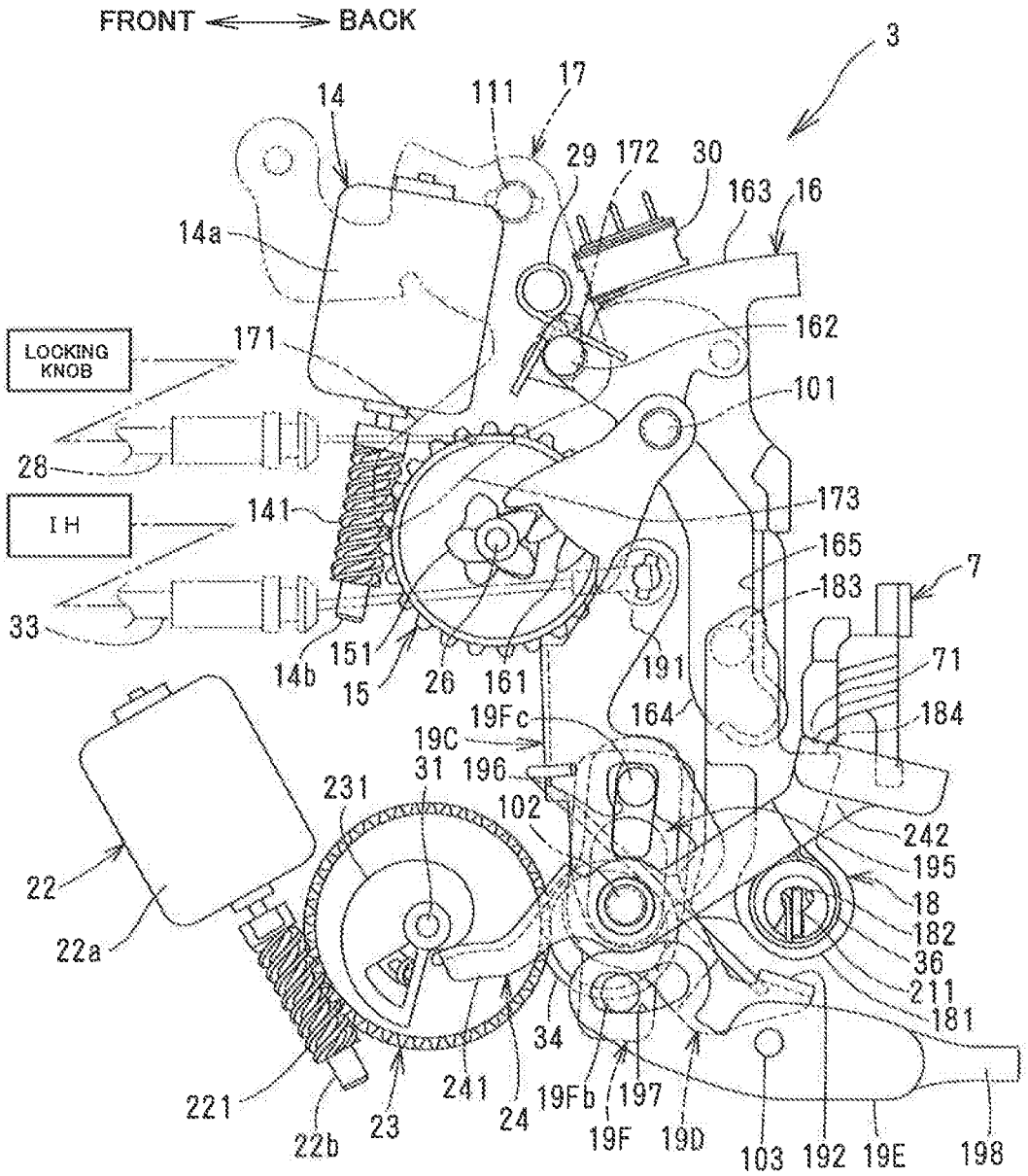
FIG. 19 is a side elevational view of the main part when the locking mechanism is in the unlock state and the childproof mechanism is in the childproof unlock state.
Figure 20:
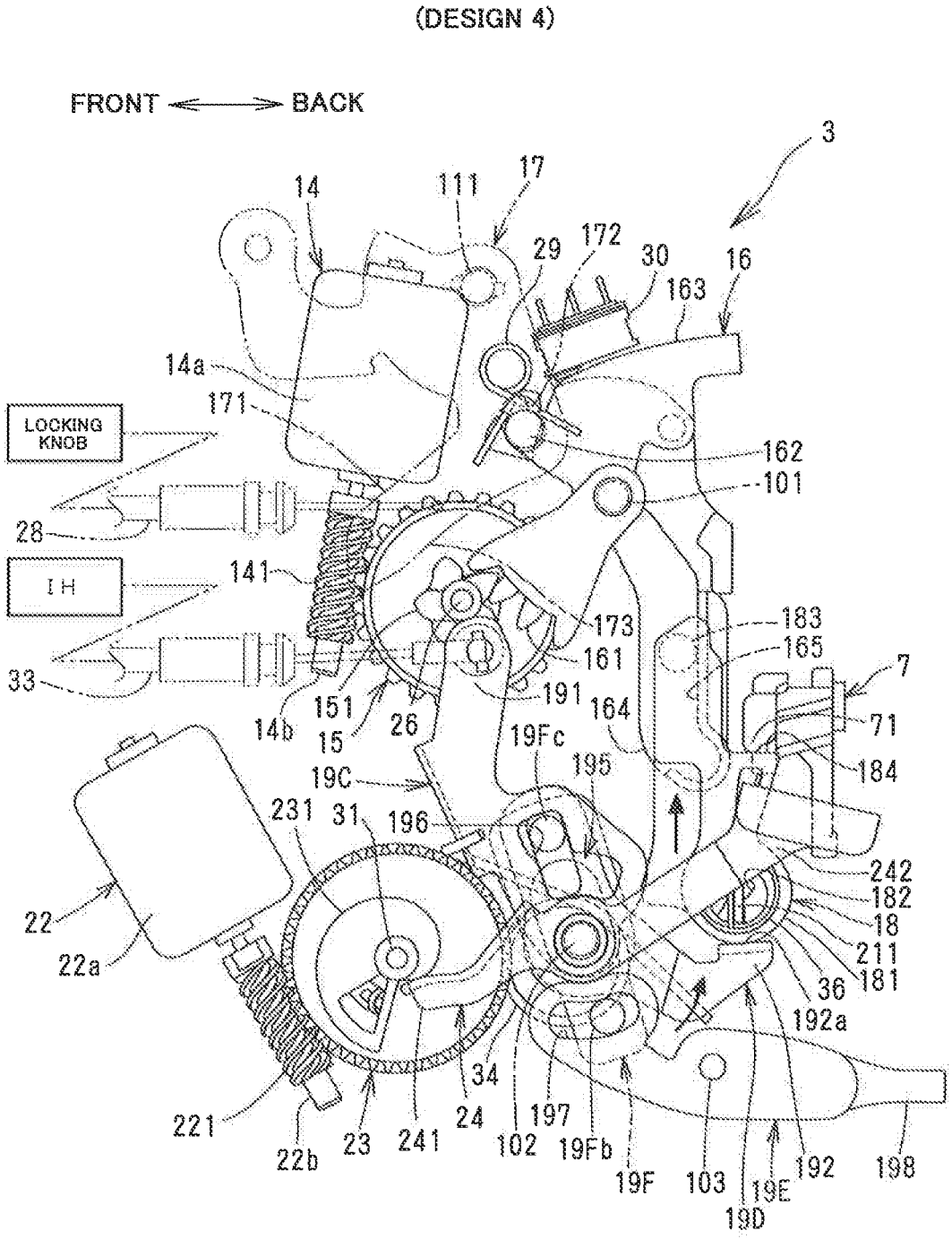
FIG. 20 is a side elevational view of the main part manually released when the locking mechanism is in the unlock state or the childproof unlock state.

In the first inside lever 190, the upper end of the first upward-extending arm 191 (corresponding to the first arm 191 of the inside lever 19 in the Design 1) is connected to the inside handle IH of the rear door RD via the connecting member 33, and the first inside lever 190 is released counterclockwise, from the set position in FIG. 19 based on a door opening action of the inside handle IH. An L-shaped control hole 195 is formed in the first inside lever 19C. The second arm 192 in the Design 1 is not provided in the first inside lever 19C, The second inside lever 19D has a vertical elongate opening 196 partially over the control hole 195 of the first inside lever 190 and a second arm 192 that extends obliquely downward(corresponding to the second arm 192 of the inside lever 19 in the Design 1).

Figure 21:
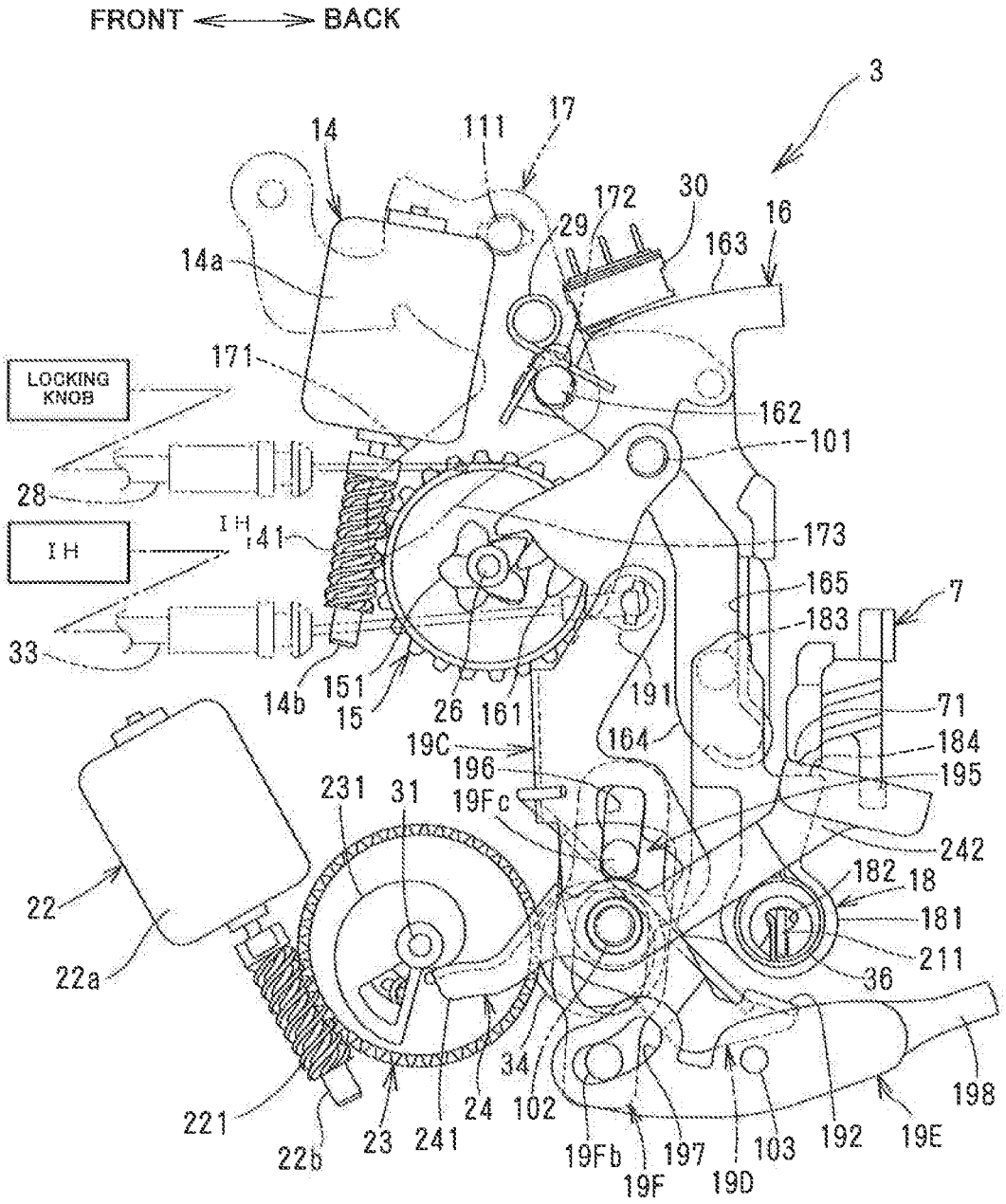
FIG. 21 is a side elevational view of the main part when the locking mechanism is in the unlock state or the childproof lock state.

The childproof operating lever 19E is pivotally mounted via a shaft 103 in the housing, and can rotate between a childproof unlock position in FIG. 19 and a childproof lock position in FIG. 21 to which the lever 19E rotates counter-clockwise by a certain angle from the childproof unlock position. The childproof operating lever 19E has an arc-shaped hole 197 at a front part, and an operating portion 198 that projects outward from the rear end of the rear door RD.

The shaft 102 vertically slides in a vertical elongate hole 19Fa of the connect link 19Fa; a lower projection 19Fb slides in an arc-shaped hole 197 of the childproof operating lever 19E; and an upper projection 19Fc slides in a control hole 195 and an elongate hole 196. Hence, when the childproof operating lever 19E is in the childproof unlock position in FIG. 19, the upper projection 19Fc engages in an upper narrower portion of the control hole 195 to enable a releasing action of the first inside lever 190 to transmit the second inside lever 19D, and when the childproof operating lever 19E is in the childproof lock position in FIG. 21, the upper projection 19Fc is positioned in a lower wider portion of the control hole 195 not to enable a releasing action of the first inside lever 190 to transmit to the second inside lever 19D.

"A childproof unlock state" described below denotes that the childproof operating lever 19E is in a childproof unlock position to enable an action of the first inside lever 19C to transmit the second inside lever 19D, and "a childproof lock state" denotes that the childproof operating lever 19E is in a childproof lock position not to enable an action of the first inside lever 190 to transmit to the second inside lever 19D.

An internal operating system in the Design 4 will be described.

In FIG. 19, when the locking mechanism is in the unlock state and the childproof mechanism is in the childproof lock state, the door is tried to open by the inside handle IH, and the first inside lever 190 rotates counterclockwise by a certain angle from the set position around the shaft 102. The rotation is transmitted to the second inside lever 19D via the connect link 19F, and the second inside lever 19D is released counterclockwise together with the first inside lever 19C. Thus, the contact portion 192*a* of the second arm 192 of the second inside lever 19D comes in contact with a lower surface of the rotary portion 181 of the opening link 18 from below, so that the opening link 18 is released upward. The releasing portion 184 of the opening link 18 comes in contact with the released portion 71 of the opening lever 7 from below, thereby rotating the opening lever 7 in a releasing direction, releasing the engagement mechanism and enabling the rear door RD to open.

When the locking mechanism in the lock state and the childproof mechanism is in the childproof unlock state, the first inside lever 180 and the second inside lever 19D are released, and the opening link 18 is released upward from the set position. But as well as the Design 1, the releasing portion 184 of the opening link 18 swings without contact with the released portion 71 of the opening lever 7, so that the door RD cannot be opened. Thus, in order to open the rear door RD due to a door-opening action of the inside handle IH as well as the Design 1, the locking motor 14 is driven by an unlocking of the locking knob inside the vehicle or with the switch inside the vehicle, the locking mechanism is shifted to the unlock state, and thereafter it is necessary that the door should be tried to open by the inside handle.

In FIG. 21, when the locking mechanism is in the unlock state and the childproof mechanism is in the childproof lock state, the rear door is tried to open by the inside handle, and the first inside lever 190 is released. But the releasing action is not transmitted to the second inside lever 19D, and the rear door RD cannot be opened. Thus, in this state, the rear door Rd can be opened outside the vehicle, but cannot be opened inside the vehicle.

=Design 5>

Figure 22:
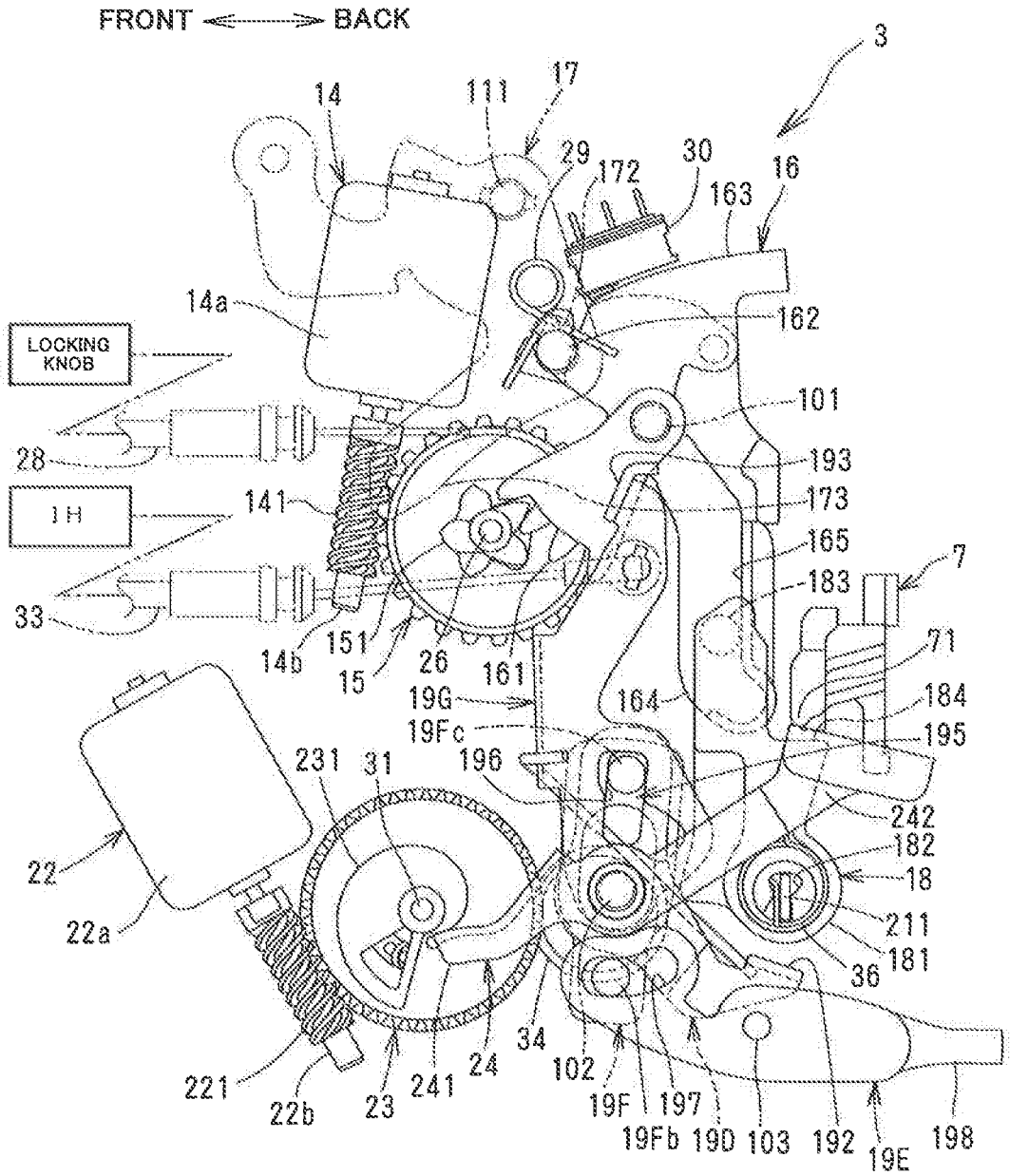
FIG. 22 is a side elevational view of the main part when the locking mechanism is in the unlock state and the childproof mechanism is in the childproof unlock state in the Design 5.
Figure 23:
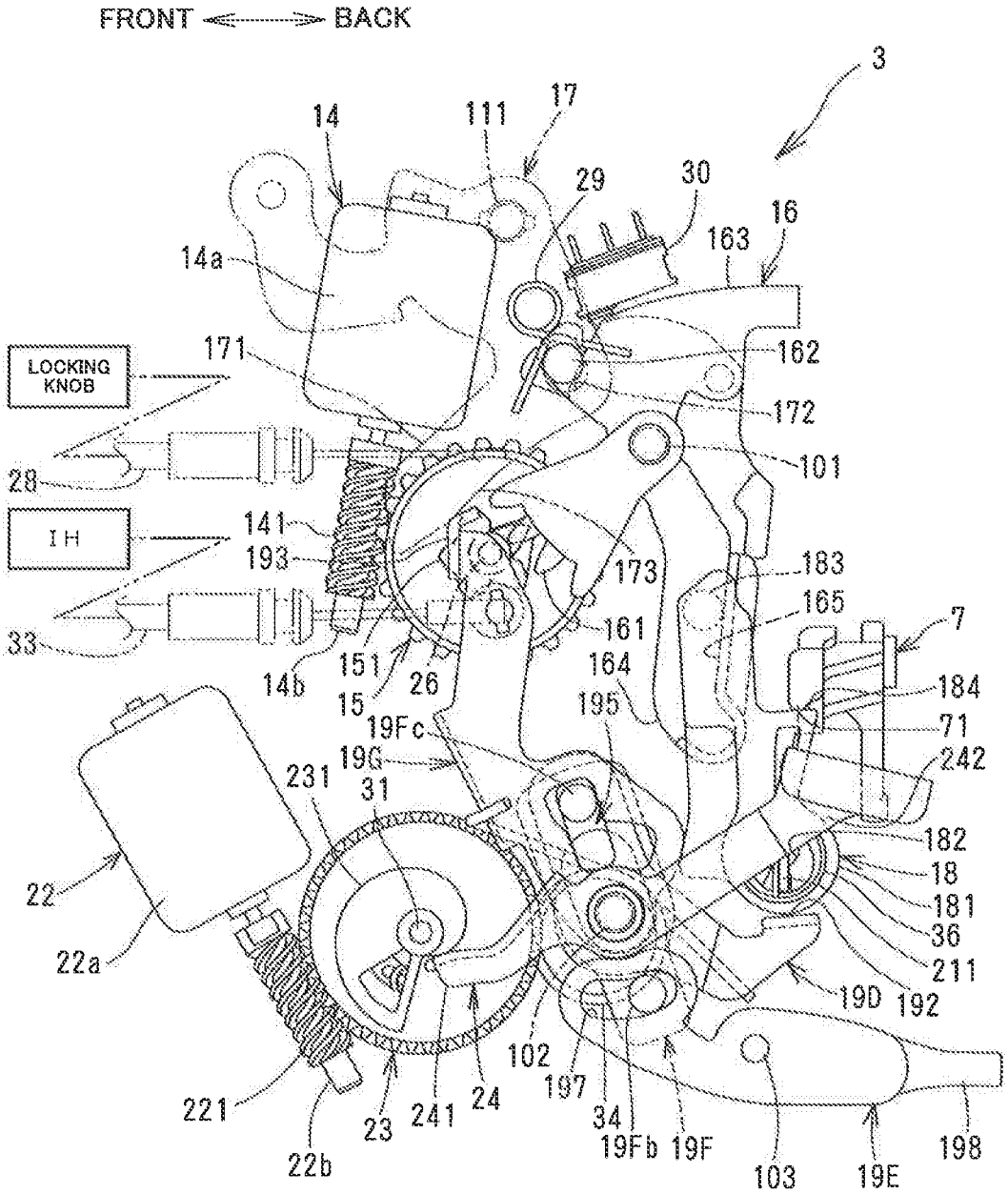
FIG. 23 is a side elevational view of the main part manually released when the locking mechanism is in the unlock state and the childproof unlock state.
Figure 24:
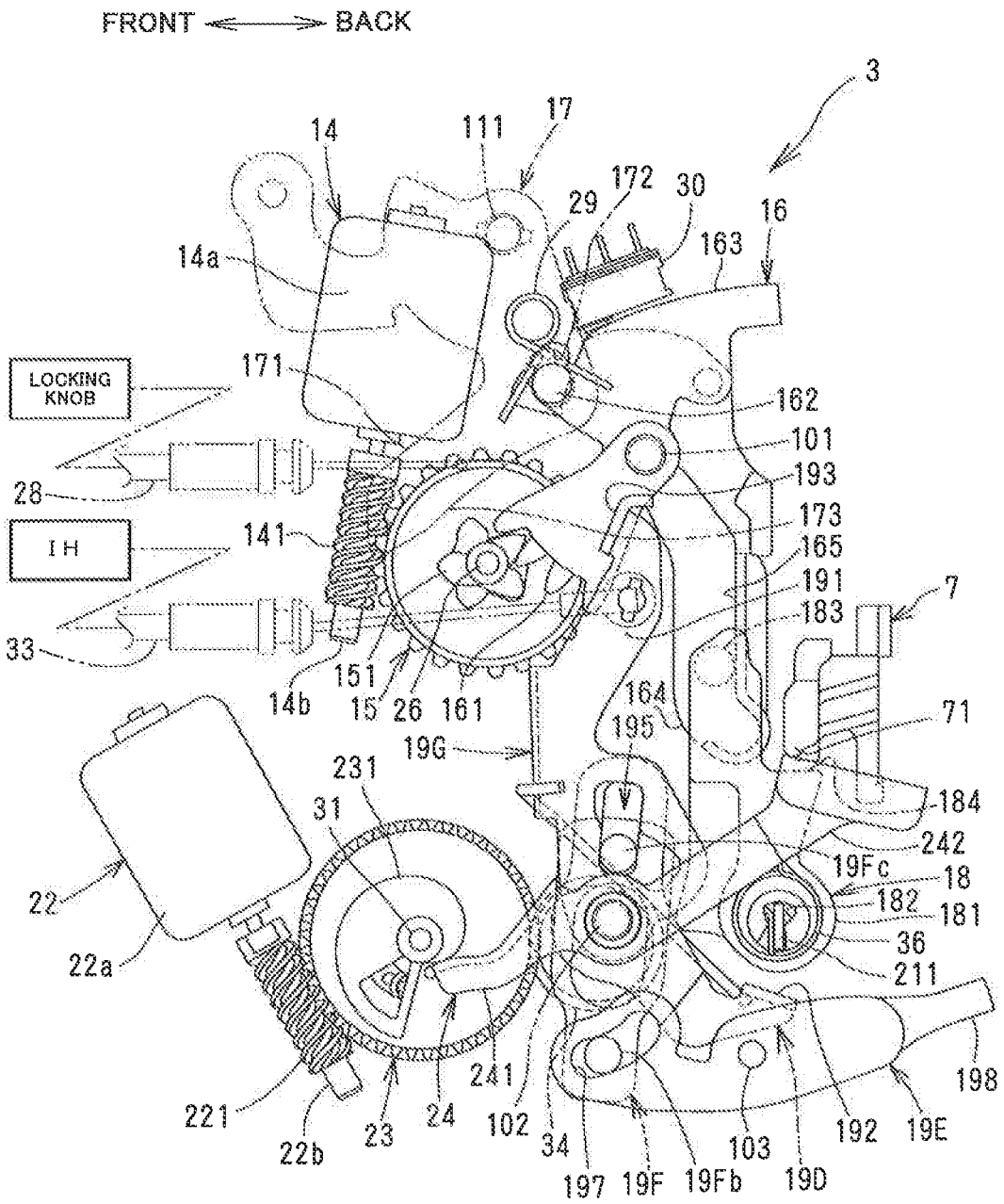
FIG. 24 is a side elevational view of the main part when the locking mechanism is in the unlock state and childproof lock state.

The Design 5 is set to a door latch device 1R for a rear door. In FIGS. 22 to 24, besides a first inside lever 19G and a second inside lever 19D in an internal operating system, there is provided a childproof mechanism comprising a childproof operating lever 19E and a connect link 19F as well as in the Design 4.

The first inside lever 19G is pivotally mounted via a shaft 102 which is the same axis for the electric release lever 24. The upper end of the first arm 191 extending upward is connected to the inside handle IH of the rear door RD via the connecting member 33, and due to a door-opening action of the inside handle IH, the first inside lever 19G is released counterclockwise from the set portion in FIG. 22. The first inside lever 19G has an L-shaped control hole 195 having the same shape as in the Design 4, and an unlocking portion 193 as well as those in the Designs 2 and 3.

The second inside lever 19D, the childproof operating lever 19E and the connect link 19F are the same as those in the foregoing Design 4, with the same numerals as those in the Design 4 in FIGS. 22 to 24 and are not described.

The internal operating system in the Design 5 will be described.

In FIG. 22, when the door is tried to open by the inside handle IH in an unlock state of the locking mechanism and in a childproof unlock state of the childproof mechanism, the first inside lever 19G and the second inside lever 19D are both released, and the engagement mechanism is released via the opening link 18 as well as the Design 4, so that the rear door RD can be opened.

When the locking mechanism is in the lock state and the childproof mechanism is in the childproof unlock state, the door is tried to open by the inside handle IH, and the first inside lever 19G and the second inside lever 19D are both released. As well as the Design 2, based on releasing of the first inside lever 19G due to a first door-opening action of the inside handle IH, in FIG. 23, the unlocking portion 193 of the first inside lever 19G comes in contact with the part 173 to shift to the unlock state. And based on releasing of the second inside lever 19D due to a second door-opening action of the inside handle IH, the engagement mechanism is released via the opening link 18, so that the rear door can be opened.

In FIG. 24, when the locking mechanism is in the unlock state and the childproof mechanism is in the childproof lock state, the rear door is tried to open by the inside handle IH and the first inside lever 19G is released. But the releasing action is not transmitted to the second inside lever 19D, so that the rear door RD cannot be opened.

When the locking mechanism is in the lock state and the childproof mechanism is in the childproof lock state, the first inside lever 19G is released due to a door-opening action of the inside handle IH of the rear door RD. Based on the releasing action, the unlocking portion 193 of the first inside lever 19G comes in contact with the part 173 of the knob lever 17, thereby shifting to the unlock state. The childproof lock state is still kept, and if it is not shifted to a childproof unlock state by the childproof operating lever 19E, the rear door RD cannot be opened by the inside handle IH. Because the locking mechanism is shifted to the unlock state, the rear door can be opened by the outside handle OH on the rear door RD outside the vehicle.

When the childproof mechanism is in the childproof lock state, the door latch device 1R in the Design 5 cannot open the rear door RD even if the rear door RD is tried to open by the inside handle IH, whether the locking mechanism is in the unlock state or the lock state. When the locking mechanism is in the lock state, it can be shifted to the unlock state by the inside handle IH on the rear door RD.

From the above, the shaft 102 for pivotally mounting the electric release lever 24 in the housing is positioned within the range C behind the releasing worm wheel 23 below the locking lever 16 in front of the opening link 18 and the opening lever 7, and an axis for the inside lever 19, 19A, 19B, 19C, 190, 190 is the same as the shaft 102 for the electric release lever 25. Without changing a position of each element forming the basic structure of the operating mechanism, the electric release lever 24 can actuate each element as below:

The electric release lever 24 can directly actuate the opening link 18.

In the Design 1, the inside lever 19 can directly actuate the opening link 18.

In the Design 2, the inside lever 19A can directly actuate the opening link 18 and the locking lever 16.

In the Design 3, the inside lever 19B can directly actuate the locking lever 16 and the electric release lever 24.

In the Design 4, the first inside lever 190 and the second inside lever 19D are provided. The second inside lever 19D can directly actuate the opening link 18.

In the Design 5, the first inside lever 19G and the second inside lever 19D are provided. The first inside lever 19G and the second inside lever 19D can directly actuate the locking lever 16 and the opening link 18 respectively.

Thus, the basic structure for the operating mechanism is used among the Designs. The releasing motor 22, the releasing worm wheel 23, the electric release lever 24 and the inside lever 19 (19A, 19B, 190. 19D, 19G) can be arranged orderly thereby making the housing and the door latch device 1F smaller.

What is claimed is:

1. A motor vehicle door latch device comprising:

an engagement unit that comprises an engagement mechanism that can engage with a striker, and an opening lever that can release the engagement mechanism; and an operating unit attached to the engagement unit and comprising an operating mechanism disposed in a housing fixed to a body of the engagement unit, the operating mechanism comprising:

a locking motor;

a locking mechanism that comprises mechanical elements and can be shifted to an unlock state for validating a door opening action of an external mechanical operating element outside a vehicle based on drive of the locking motor and to a lock state for invalidating said door opening action;

a releasing motor positioned below the locking motor;

an electric release lever that is pivotally mounted to the housing via a first shaft to rotate the opening lever by driving with the releasing motor so that the electric release lever enables the engagement mechanism to be released ; and an inside lever pivotally mounted to the housing via the first shaft that is common to the electric release lever and the inside lever and supports each of the levers independently, the inside lever rotating based on a door opening action of an internal mechanical operating element inside the vehicle to release the opening lever, wherein the locking motor and the releasing motor are controlled by an electronic control unit of the vehicle, wherein the electronic control unit electrically controls an electric detecting element that is disposed on or close to the external mechanical operating element to detect that a user touches or approaches the electric detecting element, wherein only when the electronic control unit authenticates that a regular user exclusively using an electronic key approaches the vehicle, the electronic control unit makes the electric detecting element usable, wherein when the electronic control unit makes the electric detecting element usable by said authentication and the regular user touches or approaches the electric detecting element, the electronic control unit controls driving of the releasing motor to rotate the electric release lever such that a door can be opened regardless of whether the locking mechanism is retained in the unlock state or the lock state, and wherein in the case that the locking mechanism is in the lock state, after the electronic control unit stops the driving of the releasing motor for enabling the door to open, the electronic control unit controls the locking motor to be shifted to an unlock state.

2. The motor vehicle door latch device according to claim 1 wherein, when an extension line which contacts an axis of a second shaft for pivotally mounting a releasing rotary body rotatable based on drive of the releasing motor and extends backward is a straight line A, and an extension line which contacts an uppermost portion of the releasing rotary body and extends backward is a straight line B, and a range C is between the straight line A and the straight line B, the first shaft is within the range C behind the releasing rotary body in front of the opening lever.

3. The motor vehicle door latch device according to claim 1 wherein the inside lever is connected to the internal mechanical operating element via a connecting member that passes between a case for the locking motor and a case for the releasing motor.

4. The motor vehicle door latch device according to claim 1 wherein the inside lever is rotated by the door opening action of the internal mechanical operating element when the locking mechanism is in the lock state, thereby shifting the locking mechanism to the unlock state.

5. The motor vehicle door latch device according to claim 1 wherein the inside lever is rotated by the door opening action of the internal mechanical operating element thereby actuating the electric release lever and releasing the opening lever.

6. The motor vehicle door latch device according to claim 1 wherein the operating mechanism further comprises a childproof lever that can move a childproof unlock position where rotation of the inside lever based on the door opening action of the internal mechanical operating element can be transmitted to the opening lever regardless of a state of the locking mechanism and a childproof lock position where said rotation of the inside lever cannot be transmitted.

7. The motor vehicle door latch device according to claim 6 wherein the inside lever rotates based on the door opening action of the internal mechanical operating element thereby shifting the locking mechanism to the unlock state when the locking mechanism is in the lock state.

8. The motor vehicle door latch device according to claim 4, wherein the locking mechanism comprises a knob lever connected to a locking knob on a door inside the vehicle, and the inside lever is formed with an unlocking portion which can contact with the knob lever, and wherein when the locking mechanism is in the lock state, the inside lever is rotated by the door opening action of the internal mechanical operating element and the unlocking portion is made to contact with the knob lever to rotate the knob lever, thereby shifting the locking mechanism to the unlock state.

9. The motor vehicle door latch device according to claim 5, wherein the inside lever is formed with a releasing portion which can contact with the electric release lever, and wherein when the locking mechanism is in the lock state, the inside lever is rotated by the door opening action of the internal mechanical operating element and the releasing portion is made to contact with the electric release lever to rotate the electric release lever, thereby actuating the electric release lever and releasing the opening lever.

10. The motor vehicle door latch device according to claim 7, wherein the locking mechanism comprises a knob lever connected to a locking knob on a door inside the vehicle, and the inside lever is formed with an unlocking portion which can contact with the knob lever, and wherein when the locking mechanism is in the lock state, the inside lever is rotated by the door opening action of the internal mechanical operating element and the unlocking portion is made to contact with the knob lever to rotate the knob lever, thereby shifting the locking mechanism to the unlock state.

* * * * *